US008662327B2

(12) United States Patent
Nibouar et al.

(10) Patent No.: US 8,662,327 B2
(45) Date of Patent: Mar. 4, 2014

(54) RAILWAY COUPLER CORE STRUCTURE FOR INCREASED STRENGTH AND FATIGUE LIFE OF RESULTING KNUCKLE

(75) Inventors: F. Andrew Nibouar, Chicago, IL (US); Thomas A. Marchese, Schaumburg, IL (US); Ronald P. Sellberg, Naperville, IL (US); Jerry R. Smerecky, Roselle, IL (US)

(73) Assignee: Bedloe Industries LLC, Wilmington, DE (US)

( * ) Notice: Subject to any disclaimer, the term of this patent is extended or adjusted under 35 U.S.C. 154(b) by 97 days.

(21) Appl. No.: 12/470,915

(22) Filed: May 22, 2009

(65) Prior Publication Data

US 2009/0289024 A1 Nov. 26, 2009

Related U.S. Application Data

(60) Provisional application No. 61/055,924, filed on May 23, 2008.

(51) Int. Cl.
*B61G 5/00* (2006.01)
*B22D 33/04* (2006.01)

(52) U.S. Cl.
USPC ..... 213/75 R; 164/137

(58) Field of Classification Search
USPC ..... 213/75 R, 77, 78, 88, 100 R, 109–111, 213/151–156
See application file for complete search history.

(56) References Cited

U.S. PATENT DOCUMENTS

| | | | |
|---|---|---|---|
| 450,947 | A | 4/1891 | Barnes |
| 491,174 | A | 2/1893 | Hazlehurst et al. |
| 892,563 | A | 7/1908 | Starbird |
| 1,346,224 | A | 7/1920 | McCormick |
| 1,382,530 | A | 6/1921 | Murphy |
| 1,638,885 | A | 8/1927 | Shea |
| 1,758,235 | A | 5/1930 | Nash |
| 1,932,440 | A | 10/1933 | Bazeley |
| 1,966,765 | A | 7/1934 | Murphy |
| 2,039,086 | A | 4/1936 | Kinne |
| 2,088,135 | A | 7/1937 | Johnson et al. |
| 2,350,470 | A | 6/1944 | Metzger |
| 2,617,540 | A | 11/1952 | Metzger |
| 2,688,412 | A | 9/1954 | Kulieke |
| 2,709,007 | A | 5/1955 | Metzger |
| 2,760,652 | A | 8/1956 | Blattner |

(Continued)

FOREIGN PATENT DOCUMENTS

| | | | |
|---|---|---|---|
| BE | 524450 | A | 5/1954 |
| CA | 485408 | A | 8/1952 |

(Continued)

OTHER PUBLICATIONS

International Search Report for International Application No. PCT/US2009/003154, dated Sep. 3, 2009, 3 pages.

(Continued)

*Primary Examiner* — R. J. McCarry, Jr.
(74) *Attorney, Agent, or Firm* — Nathan O. Greene; Brinks Gilson & Lione

(57) ABSTRACT

A finger core for forming the front part of a knuckle for a railcar, said finger core comprising a single opening to form a single rib at the horizontal center line of the resulting knuckle.

17 Claims, 28 Drawing Sheets

(56) References Cited

U.S. PATENT DOCUMENTS 2,769,556 A 11/1956 Metzger
2,909,293 A 10/1959 Metzger
2,948,414 A 8/1960 Metzger
2,959,299 A 11/1960 Metzger
2,997,755 A 8/1961 Olson
3,121,498 A 2/1964 Sudeck
3,168,202 A 2/1965 Cope
3,206,039 A 9/1965 Metzger
3,572,518 A 3/1971 Wisler
3,604,569 A 9/1971 Kulieke
3,613,902 A 10/1971 Altherr
3,627,145 A 12/1971 Altherr
3,635,356 A 1/1972 Shramovich
3,635,358 A 1/1972 Altherr
3,637,089 A 1/1972 Jwuc et al.
3,640,402 A 2/1972 Altherr et al.
3,670,901 A 6/1972 Metzger
3,675,787 A 7/1972 Krauskopf
3,698,570 A 10/1972 Metzger
3,698,571 A 10/1972 Hawthorne
3,717,261 A 2/1973 DePenti
3,722,708 A 3/1973 Ion et al.
3,735,877 A 5/1973 Bossong
3,767,062 A 10/1973 Holibaugh
3,779,397 A 12/1973 DePenti
3,833,131 A 9/1974 Altherr
3,850,311 A 11/1974 Kaufhold
3,850,312 A 11/1974 Baker, Sr.
3,853,228 A 12/1974 Metzger
3,854,599 A 12/1974 Day et al.
3,856,154 A 12/1974 DePenti
3,856,155 A 12/1974 Altherr
3,856,156 A 12/1974 Metzger
3,857,495 A 12/1974 Kaufhold
3,858,729 A 1/1975 Altherr
3,860,121 A 1/1975 Snell
3,872,978 A 3/1975 Altherr
3,881,602 A 5/1975 Altherr et al.
3,923,164 A 12/1975 Dalton
3,971,479 A 7/1976 DePenti
3,972,421 A 8/1976 DePenti
RE29,011 E 10/1976 Altherr
3,998,337 A 12/1976 Altherr
4,024,958 A 5/1977 Kaufhold
4,051,954 A 10/1977 Roberts
4,064,998 A 12/1977 Dilg et al.
4,081,082 A 3/1978 Scherrer et al.
4,084,704 A 4/1978 Metzger
4,084,705 A 4/1978 Oshinsky et al.
4,090,614 A 5/1978 Altherr et al.
4,090,615 A 5/1978 Martin
4,093,079 A 6/1978 Cope
4,119,209 A 10/1978 Jwuc
4,129,219 A 12/1978 Polanin
4,135,629 A 1/1979 Dilg et al.
4,143,701 A 3/1979 Oshinsky et al.
4,146,143 A 3/1979 Schelle
4,172,530 A 10/1979 Altherr et al.
4,206,849 A 6/1980 Kaim
4,230,228 A 10/1980 Kaim
4,245,747 A 1/1981 Roberts
4,258,628 A 3/1981 Altherr
4,267,935 A 5/1981 Dilg
4,287,834 A 9/1981 Zehnder et al.
4,316,549 A 2/1982 Klimowicz
4,333,576 A 6/1982 Kaim
4,363,414 A 12/1982 Kaim
4,391,380 A 7/1983 Hoose
4,398,641 A 8/1983 Klimowicz
4,426,012 A 1/1984 Adams, III et al.
4,438,854 A 3/1984 Baughman et al.
4,438,855 A 3/1984 Altherr
4,445,617 A 5/1984 Elliott
4,452,299 A 6/1984 Gruber et al.
4,466,546 A 8/1984 Altherr et al.
4,474,732 A 10/1984 Lynn
4,480,758 A 11/1984 Hurt et al.
4,585,133 A 4/1986 Cope
4,595,109 A 6/1986 McClurg
4,605,133 A 8/1986 Altherr
4,637,518 A 1/1987 Hanula
4,640,422 A 2/1987 Elliott
4,645,085 A 2/1987 Hanula et al.
4,706,826 A 11/1987 Elliott et al.
4,776,474 A 10/1988 Terlecky et al.
4,811,854 A 3/1989 Elliott
4,848,611 A 7/1989 Terlecky et al.
4,927,035 A 5/1990 Geng et al.
4,976,362 A 12/1990 Kaufhold
4,976,363 A 12/1990 Altherr
4,982,781 A 1/1991 Carpenter et al.
4,984,696 A 1/1991 Altherr
5,050,751 A 9/1991 Thrift et al.
5,139,161 A 8/1992 Long
5,145,076 A 9/1992 Murphy et al.
5,285,911 A 2/1994 Altherr
5,305,899 A 4/1994 Kaufhold
5,312,007 A 5/1994 Kaufhold et al.
5,415,304 A 5/1995 Hanes et al.
5,424,376 A 6/1995 Chang et al.
5,427,257 A 6/1995 Hanes et al.
5,479,981 A 1/1996 Kim
5,482,675 A 1/1996 Shotwell et al.
D369,756 S 5/1996 Noel
5,582,307 A * 12/1996 Hawthorne et al. ..... 213/109
5,630,519 A 5/1997 Burke et al.
5,833,086 A 11/1998 Kaufhold
5,878,897 A 3/1999 Lazzaro et al.
5,915,451 A 6/1999 Nakamura
5,927,522 A 7/1999 Carifa
5,954,212 A 9/1999 Beatty et al.
6,005,021 A 12/1999 Chen et al.
6,062,406 A 5/2000 Duncan
6,129,227 A * 10/2000 Openchowski et al. ..... 213/111
6,148,733 A 11/2000 Gagliardino
6,206,215 B1 3/2001 Maa
6,237,785 B1 5/2001 Daugherty, Jr.
6,360,906 B1 3/2002 Kaufhold et al.
6,446,820 B1 9/2002 Barker et al.
6,488,163 B1 12/2002 Wurzer et al.
6,588,490 B2 7/2003 Rommel et al.
6,681,943 B2 1/2004 Barker et al.
6,758,919 B2 7/2004 Milligan
6,783,610 B2 8/2004 Shirley et al.
6,796,448 B1 9/2004 Wilt et al.
6,944,925 B2 9/2005 Brueckert et al.
7,020,977 B2 4/2006 Brueckert et al.
7,059,062 B2 6/2006 Brueckert et al.
7,143,522 B2 12/2006 Brueckert et al.
7,171,734 B2 2/2007 Brueckert et al.
7,171,758 B2 2/2007 Brueckert et al.
7,302,994 B2 * 12/2007 Mautino et al. ..... 164/137
7,337,826 B2 3/2008 Mautino et al.
7,360,318 B2 4/2008 Brueckert et al.
8,196,762 B2 6/2012 Smerecky
8,201,613 B2 6/2012 Marchese et al.
2002/0007931 A1 1/2002 Crafton et al.
2003/0127412 A1 7/2003 Mautino et al.
2003/0221811 A1 12/2003 Smith et al.
2004/0173555 A1 9/2004 Wilt et al.
2005/0160581 A1 7/2005 Brueckert et al.
2005/0160582 A1 7/2005 Brueckert et al.
2005/0160584 A1 7/2005 Brueckert et al.
2005/0184021 A1 8/2005 Mautino et al.
2006/0113267 A1 6/2006 Mautino et al.
2007/0084818 A1 4/2007 Brabb et al.
2007/0125510 A1 6/2007 Mautino et al.
2007/0130773 A1 6/2007 Brueckert et al.
2008/0083690 A1 4/2008 Mautino et al.
2012/0228256 A1 9/2012 Marchese et al.

(56) References Cited

U.S. PATENT DOCUMENTS

FOREIGN PATENT DOCUMENTS

| | | | |
|---|---|---|---|
| CA | 510469 | A | 3/1955 |
| CA | 753964 | A | 3/1957 |
| CA | 540837 | A | 5/1957 |
| CA | 547137 | A | 10/1957 |
| CA | 905353 | A | 7/1972 |
| CA | 1022116 | A1 | 12/1977 |
| CA | 1034085 | A1 | 7/1978 |
| CA | 1039683 | A1 | 10/1978 |
| CA | 1041050 | A1 | 10/1978 |
| CA | 1045085 | A1 | 12/1978 |
| CA | 1079234 | A1 | 6/1980 |
| CA | 1087135 | A1 | 10/1980 |
| CA | 1089808 | A1 | 11/1980 |
| CA | 1093021 | A1 | 1/1981 |
| CA | 1098869 | A1 | 4/1981 |
| CA | 1108560 | A1 | 9/1981 |
| CA | 1195660 | A1 | 10/1985 |
| CA | 1226244 | A1 | 9/1987 |
| CA | 1251170 | A1 | 3/1989 |
| CA | 2027987 | A1 | 5/1991 |
| CA | 2054390 | A1 | 5/1992 |
| CA | 2171030 | A1 | 11/1996 |
| CA | 2260658 | A1 | 9/1999 |
| CA | 2395875 | A1 | 7/2003 |
| CA | 2573306 | A1 | 2/2006 |
| CN | 101010231 | A | 8/2007 |
| CN | 101402131 | A | 4/2009 |
| EP | 1531018 | A1 | 5/2005 |
| GB | 185657 | A | 9/1922 |
| GB | 221691 | A | 9/1924 |
| GB | 326575 | A | 3/1930 |
| GB | 355247 | A | 8/1931 |
| GB | 743098 | A | 1/1956 |
| GB | 902971 | A | 8/1962 |
| GB | 1477368 | A | 6/1977 |
| GB | 2292899 | A | 3/1996 |
| GB | 2300611 | A | 11/1996 |
| WO | WO 01/81024 | A1 | 11/2001 |
| WO | WO 2006/017412 | A1 | 2/2006 |
| WO | WO 2009/142746 | A1 | 11/2009 |
| WO | WO 2009/142747 | A1 | 11/2009 |
| WO | WO 2009/142748 | A1 | 11/2009 |
| WO | WO 2009/142749 | A1 | 11/2009 |
| WO | WO 2009/142750 | A1 | 11/2009 |
| WO | WO 2009/142757 | A1 | 11/2009 |
| WO | WO 2011/084992 | A1 | 7/2011 |

OTHER PUBLICATIONS

International Preliminary Report on Patentability for International Application No. PCT/US2009/003154, dated Nov. 23, 2010, 8 pages.
International Search Report for International Application No. PCT/US2009/003155, dated Aug. 27, 2009, 3 pages.
International Preliminary Report on Patentability for International Application No. PCT/US2009/003155, dated Nov. 23, 2010, 7 pages.
International Search Report for International Application No. PCT/US2009/003157, dated Sep. 10, 2009, 3 pages.
International Preliminary Report on Patentability for International Application No. PCT/US2009/003157, dated Nov. 23, 2010, 8 pages.
International Search Report for International Application No. PCT/US2009/003158, dated Aug. 27, 2009, 2 pages.
International Preliminary Report on Patentability for International Application No. PCT/US2009/003158, dated Nov. 23, 2010, 9 pages.
International Search Report for International Application No. PCT/US2009/003159, dated Aug. 31, 2009, 3 pages.
International Preliminary Report on Patentability for International Application No. PCT/US2009/003159, dated Nov. 23, 2010, 8 pages.
International Search Report for International Application No. PCT/US2009/003170, dated Sep. 1, 2009, 3 pages.
International Preliminary Report on Patentability for International Application No. PCT/US2009/003170, dated Nov. 23, 2010, 9 pages.
International Search Report for International Application No. PCT/US2011/020207, dated Apr. 15, 2011, 2 pages.
Armstrong Mold Corporation, "Precision Air-Set Sand Casting Process," retrieved Oct. 7, 2009, from http://www.armstrongmold.com/pages/airset.html, 2 pages.
Bernier Cast Metals Inc., "Air-Set (No Bake) Process," retrieved Oct. 7, 2009, from http://www.bernierinc.com/AirSet.html, 1 page.
Bernier Cast Metals Inc., "Green Sand Molding," retrieved Oct. 7, 2009, from http://www.bernierinc.com/GreenSandMolding.html, 1 page.
Butler Foundry, "Air Set Casting," retrieved Oct. 7, 2009, from http://www.foundrycasting.co.uk/air-set-casting.html, 2 pages.
CUSTOM PartNet, "Sand Casting," retrieved Oct. 7, 2009, from http://www.custompartnet.com/wu/SandCasting, 7 pages.
SCRATA Specifications Committee, "Comparators for the Definition of Surface Quality of Steel Castings," publication date unknown, 32 pages.
SFSA Supplement 3, "Dimensional Capabilities of Steel Castings," retrieved Jan. 12, 2010, from www.sfsa.org/sfsa/pubs/hbk/s3.pdf, 33 pages.
Wikipedia, "Chill (casting)," retrieved Oct. 7, 2009, from http://en.wikipedia.org/wiki/Chill_(foundry), 2 pages.
Wikipedia, "Cope and drag," retrieved Oct. 7, 2009, from http://en.wikipedia.org/wiki/Cope_and_drag, 1 page.
Wikipedia, "Flask (casting)," retrieved Oct. 7, 2009, from http://en.wikipedia.org/wiki/Casting_flask, 1 page.
Wikipedia, "Molding sand," retrieved Oct. 7, 2009, from http://en.wikipedia.org/wiki/Molding_sand, 1 page.
Wikipedia, "No bake mold casting," retrieved Oct. 7, 2009, from http//en.wikipedia.org/wiki/No_bake_mold_casting, 2 pages.
Wikipedia, "Sand Casting," retrieved Oct. 7, 2009, from http://en.wikipedia.org/wiki/Sand_casting, 10 pages.
Transactions of the American Foundrymen's Society, Proceedings of the Ninety-first Annual Meeting, Apr. 5-10, 1987. vol. 95, 21 pages.
Unknown Author, "A.R.A. Type "E" Coupler," Railway Mechanical Engineer, May 1932, pp. 207-208.
Unknown Author, "Report on Couplers and Draft Gears," Railway Mechanical Engineer, Jul. 1933, pp. 243-244.
Unknown Author, "Steel Castings Handbook," 6$^{th}$ Edition, Steel Founders' Society of America, © 1995, 3 pages.
Walton, Charles F. et al., "Iron Castings Handbook," Iron Castings Society, Inc., © 1981, 5 pages.
Office Action from co-pending U.S. Appl. No. 12/471,029, dated Feb. 16, 2011, 9 pages.
Office Action from co-pending U.S. Appl. No. 12/470,883, dated Mar. 2, 2011, 8 pages.
Office Action from co-pending U.S. Appl. No. 12/471,110, dated Mar. 17, 2011, 11 pages.
Office Action from co-pending U.S. Appl. No. 12/471,053, dated Mar. 21, 2011, 12 pages.
Office Action from co-pending U.S. Appl. No. 12/471,136, dated Jun. 21, 2011, 9 pages.
Office Action from co-pending U.S. Appl. No. 12/685,346, dated Aug. 16, 2011, 7 pages.
Office Action from co-pending U.S. Appl. No. 12/470,883, dated Sep. 21, 2011, 8 pages.
Specification for U.S. Appl. No. 12/470,883.
Specification for U.S. Appl. No. 12/471,029.
Specification for U.S. Appl. No. 12/471,053.
Specification for U.S. Appl. No. 12/471,110.
Specification for U.S. Appl. No. 12/471,136.
Specification for U.S. Appl. No. 12/685,346.
International Search Report for International Application No. PCT/US2012/037879, dated Aug. 30, 2012 (13 pages).
International Search Report for International Application No. PCT/US2012/037907, dated Aug. 30, 2012 (13 pages).
International Search Report and Written Opinion for International Patent Application No. PCT/US2010/062574, dated May 30, 2011 (13 pages).
International Preliminary Report on Patentability for International Patent Application No. PCT/US2011/020207, dated Dec. 16, 2011 (7 pages).

(56) References Cited

OTHER PUBLICATIONS

International Search Report for International Application No. PCT/US2012/037952, dated May 15, 2012 (15 pages).
International Search Report for International Application No. PCT/US2012/037949, dated May 15, 2012 (14 pages).
Office Action for Chinese Application No. 200980123762.8, dated Sep. 26, 2012 (15 pages).
Office Action for Chinese Application No. 200980122327.3, dated Sep. 27, 2012 (13 pages).
Office Action from co-pending U.S. Appl. No. 12/471,029, dated Oct. 26, 2011 (14 pages).
Office Action from co-pending U.S. Appl. No. 12/470,915, dated Feb. 16, 2011 (8 pages).
Office Action from co-pending U.S. Appl. No. 12/470,915, dated Nov. 15, 2011 (17 pages).
Office Action from co-pending U.S. Appl. No. 12/471,110, dated Nov. 30, 2011 (13 pages).
Office Action from co-pending U.S. Appl. No. 12/471,110, dated Mar. 14, 2012 (7 pages).
Notice of Allowance from co-pending U.S. Appl. No. 12/471,110, dated Apr. 5, 2012 (8 pages).
Office Action from co-pending U.S. Appl. No. 12/471,053, dated Dec. 7, 2011 (20 pages).
Notice of Allowance from co-pending U.S. Appl. No. 12/471,053, dated Mar. 30, 2012 (7 pages).
Office Action from co-pending U.S. Appl. No. 12/471,136, dated Dec. 2, 2011 (20 pages).
Office Action from co-pending U.S. Appl. No. 12/471,136, dated May 9, 2012 (9 pages).
Office Action from co-pending U.S. Appl. No. 12/471,136, dated Jul. 24, 2012 (8 pages).
Office Action from co-pending U.S. Appl. No. 12/685,346, dated May 8, 2012 (7 pages).
Office Action from co-pending U.S. Appl. No. 12/685,346, dated Jul. 27, 2012 (7 pages).
Office Action from co-pending U.S. Appl. No. 12/470,883, dated Apr. 13, 2012 (11 pages).
Examiner's Report for corresponding Canadian application CA 2,725,188, issued Mar. 1, 2012, (3 pages).

* cited by examiner

Section A - A

Section B - B

SECTION C-C

SECTION D-D

RAILWAY COUPLER CORE STRUCTURE FOR INCREASED STRENGTH AND FATIGUE LIFE OF RESULTING KNUCKLE

RELATED APPLICATIONS

This application claims priority to U.S. provisional application Ser. No. 61/055,924 filed May 23, 2008, the disclosure of which is incorporated by reference herein in its entirety.

FIELD OF INVENTION

The present invention relates generally to the field of railroad couplers, and more specifically to the core for the front portion of the knuckle and the core for the rear portion of the knuckle.

BACKGROUND

The front core of a knuckle is commonly referred to as the finger core. The finger core is commonly constructed to produce an internal cavity having thin ribs. These ribs have demonstrated a weakness to the load environment with the development of fatigue and/or hot tear cracks. The fatigue cracks can grow over time and eventually lead to knuckle failure which results in separation of railcars. Separately, internal or external cracks in the knuckle are a cause for replacement of the knuckle.

The rear core of a knuckle is commonly referred to as the kidney core. Knuckles can sometimes break within this portion of the knuckle and this has proven to be a very undesirable location for a failure. A failure in this region of the knuckle can lead to knuckle jamming within the coupler body and prevent a change out of a failed knuckle, thereby requiring the entire coupler assembly to be replaced, a very costly repair.

There is a need to improve the strength and/or fatigue life in these areas of the knuckle while still allowing it to be the weak link in the coupler system and fail under high loading conditions.

SUMMARY OF INVENTION

In a first embodiment, a finger core for forming the front part of a knuckle for a railcar is provided and comprises a single opening to form a single rib at the horizontal center line of the resulting knuckle.

In a second embodiment, a core for forming the rear part of a knuckle for a railcar is provided and comprises a kidney core section and a pivot pin core section, the kidney core section having maximized interior fillets and reduced buffing shoulder portions.

In a third embodiment, a set of cores for forming knuckle for a railcar coupler that has increased strength and/or fatigue life is provided and comprises a finger core for forming the front part of a knuckle for a railcar, said finger core comprising a single opening to form a single rib in the resulting knuckle; and a core for forming the rear part of a knuckle for a railcar, said core comprising a kidney core section and a pivot pin core section; the kidney core section having maximized interior fillets and reduced buffing shoulder portions.

In a fourth embodiment, a railway coupler knuckle with increased strength and fatigue life is provided that comprises a single thick rib in said knuckle.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

DETAILED DESCRIPTION OF THE DRAWINGS AND THE PRESENTLY PREFERRED EMBODIMENTS

The goal of the present invention is to improve the strength and fatigue life of the knuckle by utilizing two unique cores. The completed knuckle 12 is shown in FIGS. 1-5 for reference. Referring to FIG. 6, the first specialized core is a finger core 10 and the second specialized core is a kidney core 12 that also includes a pivot pin core 13.

Figure 8:
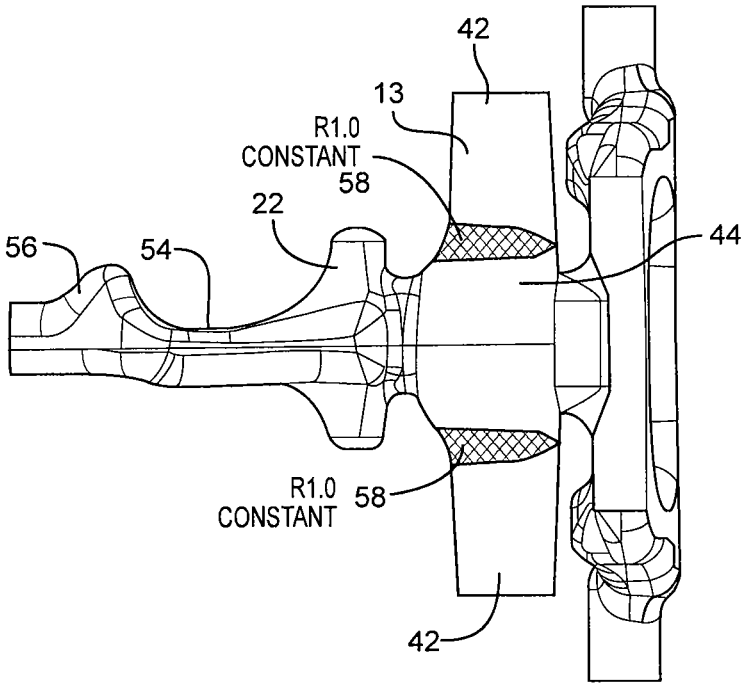
FIG. 8 is a side view of the finger and kidney cores of FIG. 6*a*.
Figure 9:
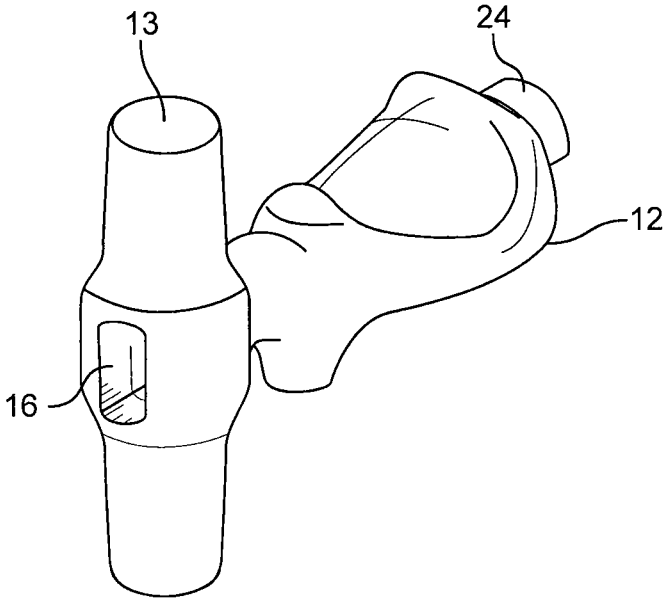
FIG. 9 is a perspective view of the kidney core of FIG. 6*a*.
Figure 10:
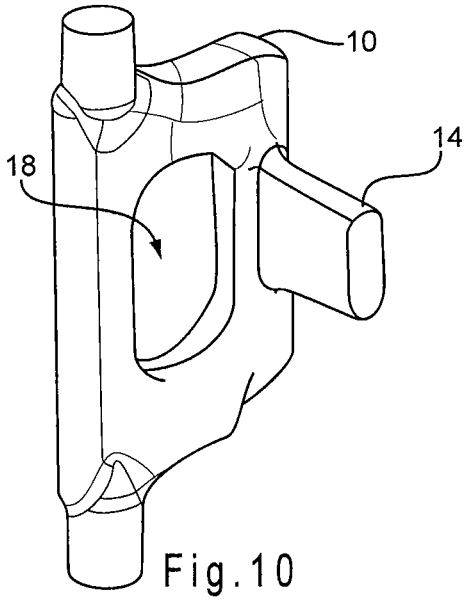
FIG. 10 is a perspective view of the finger core of FIG. 6*a*.

With respect to the front portion of the knuckle, the present invention utilizes a unique shape of the finger core 10, shown from different angles in FIGS. 6*b*, 6*c*, 10-20, 23-33 and 35-43. FIGS. 6-8 and 11-43 show the finger core 10 connected to the kidney core 12 to form the knuckle 21. FIG. 6 shows the finger core 10 about to be connected to the kidney core 12 through the interaction of an extension 14 on the finger core 10 and an opening 16 on the pivot pin core 13. FIGS. 9 and 10 show the finger core 10 alone.

Figure 45:
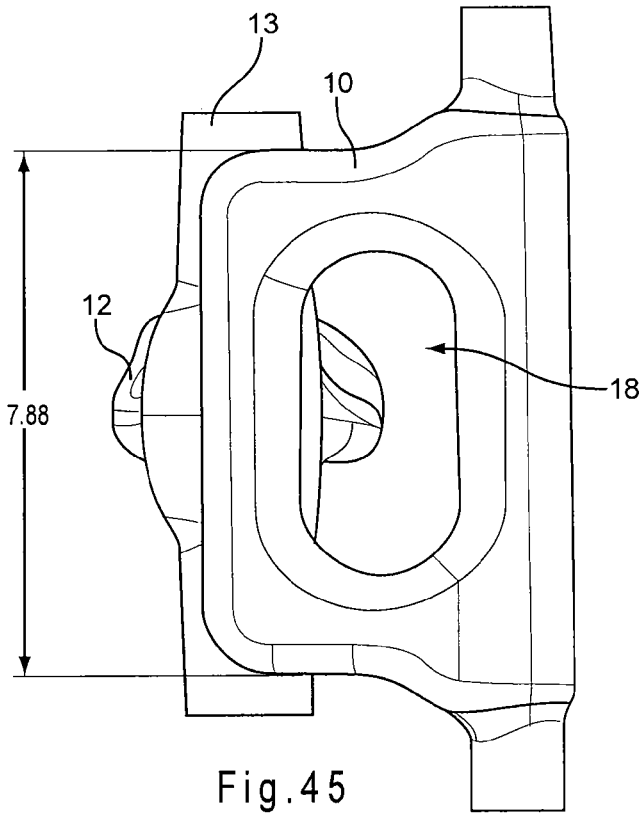
FIG. 45 is a side plan view of the of the finger and kidney cores of FIG. 6*a*.

A completed knuckle 21 is shown in FIGS. 1-5. The finger core 10 forms the internal surfaces of the front face 26, nose 28, pulling face 30, heel 32 and flag hole 34 of the knuckle 21. The main section of the finger core 10 is preferably about 5.0" wide by 7.9" tall with a 2.1" wide by 4.9" tall rib 15 in the center. (FIGS. 6*c* and 45). The finger core 10 extends outward from the center to produce the 1.3" flag hole 24 on both the top and bottom of the nose 28. The internal radii 36 of the finger core 10 are preferably smoothed to reduce stresses and increase fatigue life. The finger core 10 also includes a flag hole core 72.

The finger core 10 is designed such that an opening 18 forms a single thick rib 15 at the horizontal centerline of the resulting knuckle to more efficiently transfer the load to the pulling lugs of the knuckle and to reduce the stresses in the knuckle 21. As shown in the Figures, the number of corners 19 have been reduced down to four and larger radii than those present in the prior art are used in all four corners 19. Larger core fillets are also utilized. Exemplary dimensions of the opening 18 are shown in FIG. 6*c* as about 2.1" wide and about 4.9" high, but it is to be understood that other dimensions of this opening are also possible.

Figure 1:
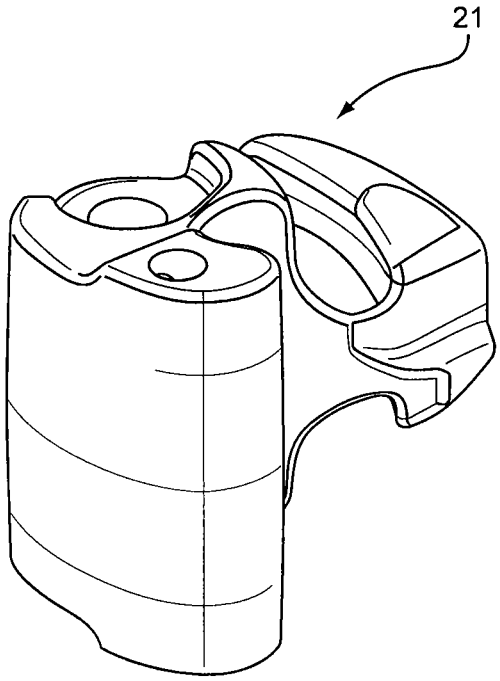
FIG. 1 is a perspective view of a knuckle.
Figure 2:
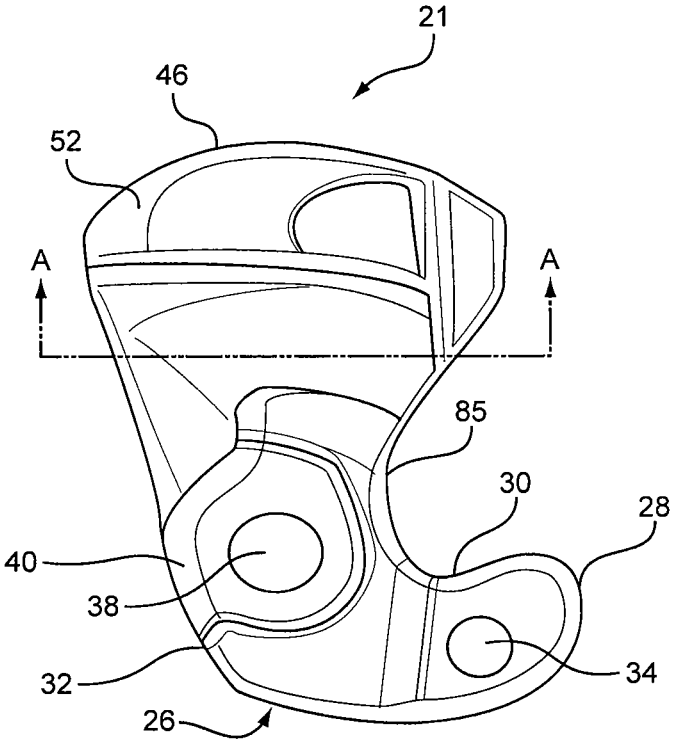
FIG. 2 is a top plan view of the knuckle of FIG. 1.
Figure 3:
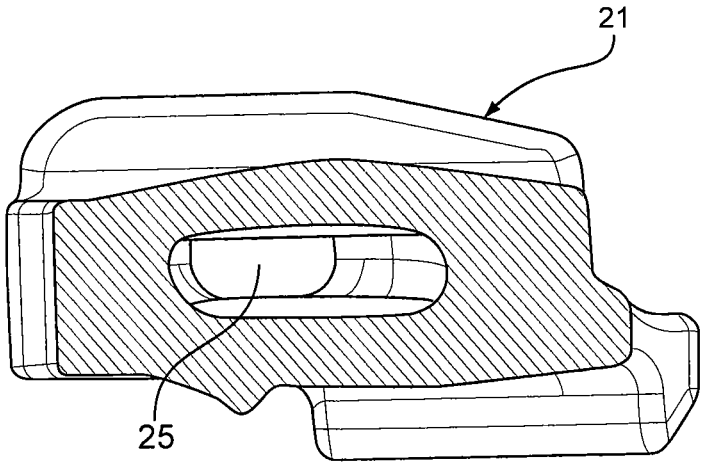
FIG. 3 is a cross-sectional view of the knuckle of FIG. 1 along line A-A from FIG. 2.
Figure 4:
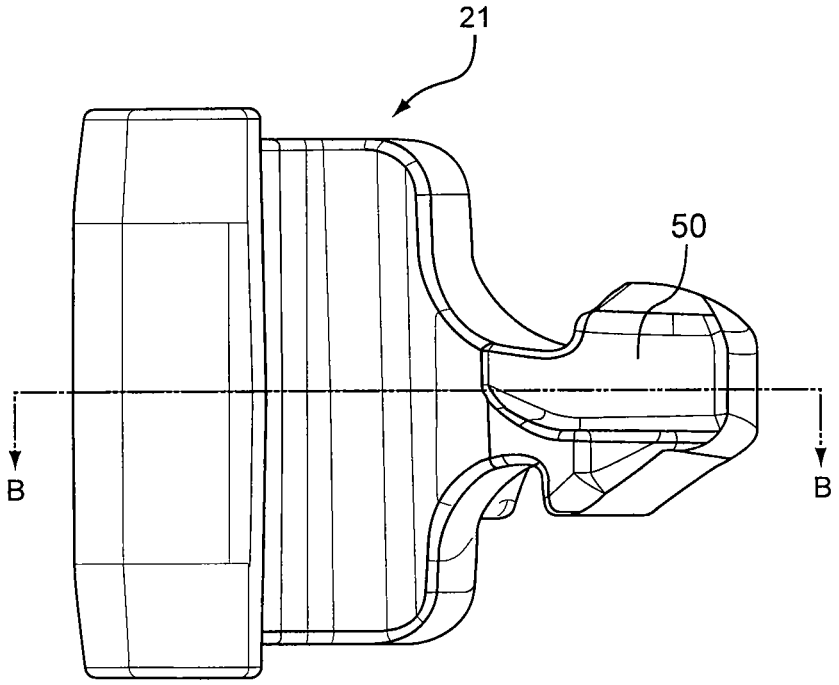
FIG. 4 is a side plan view of the knuckle of FIG. 1.
Figure 5:
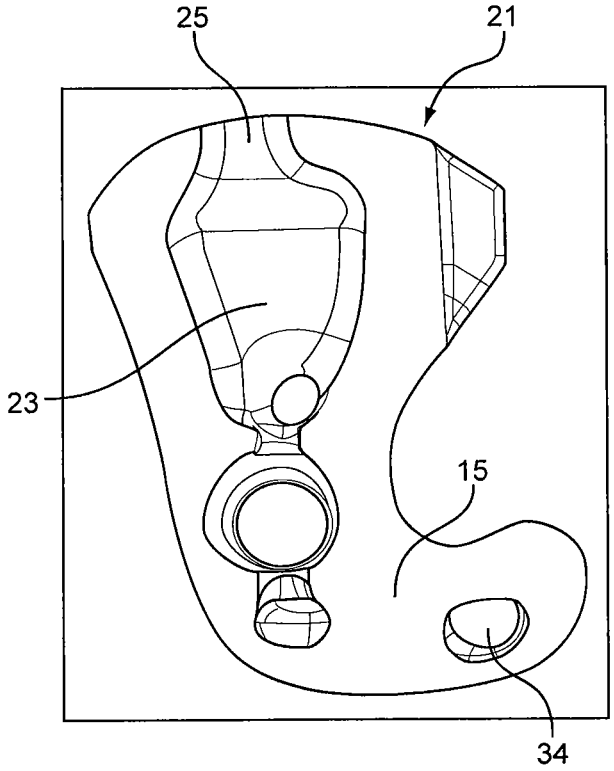
FIG. 5 is a cross sectional view of the knuckle of FIG. 1 along line B-B from FIG. 4.
Figure 6:
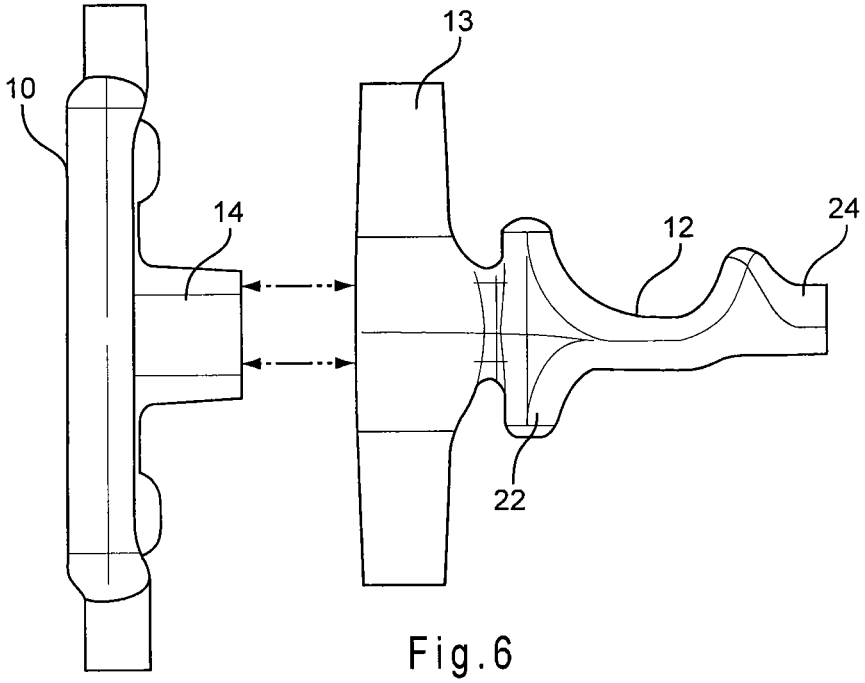
FIG. 6 is a side view of the finger core and the kidney core before they are attached.

The interaction of these modifications results in lower stresses on the resulting rib 15, which can be seen in the finished knuckle 21 shown in FIGS. 1-5, especially in FIG. 5, which is a cross sectional view along line B-B of FIG. 4. Furthermore, FIG. 5 also offers the best view of the internal structure 23 created by the kidney 12 and pivot pin cores 13 along with the finger core 10.

With respect to the rear portion of the core, the present invention utilizes a unique kidney core 12 shape. Interior fillets 20 of the core 12 and the resultant wall thickness and profile have been maximized. Additionally, the buffing shoulder portions 22 of the core have been reduced in size to maximize wall thickness. Furthermore, the core support 24 at the tail of the knuckle 21 has been optimized in shape. The location of the tail support hole 25, the size, the shape of the hole, and then the wall thickness and the resulting interior fillets of these features have all been optimized to reduce stress concentrations while maintaining an acceptable weight of the knuckle 21.

For simplification, the measurements in this application have been rounded to the nearest tenth, although they are often shown in the Figures down to the hundredths or thousandths.

Figure 44:
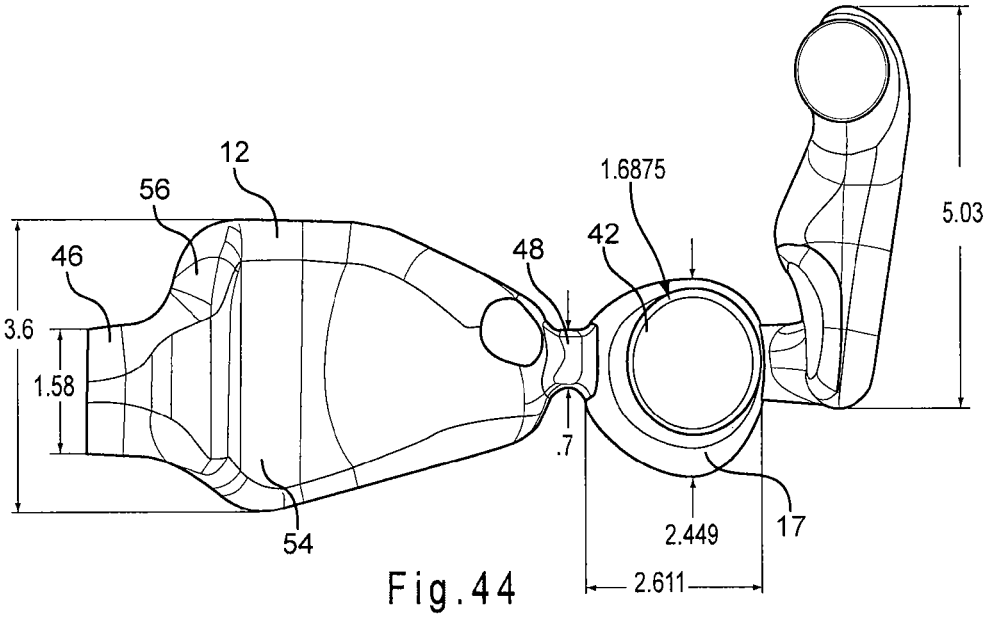
FIG. 44 is a top plan view of the finger and kidney cores of FIG. 6*a*.
Figure 46:
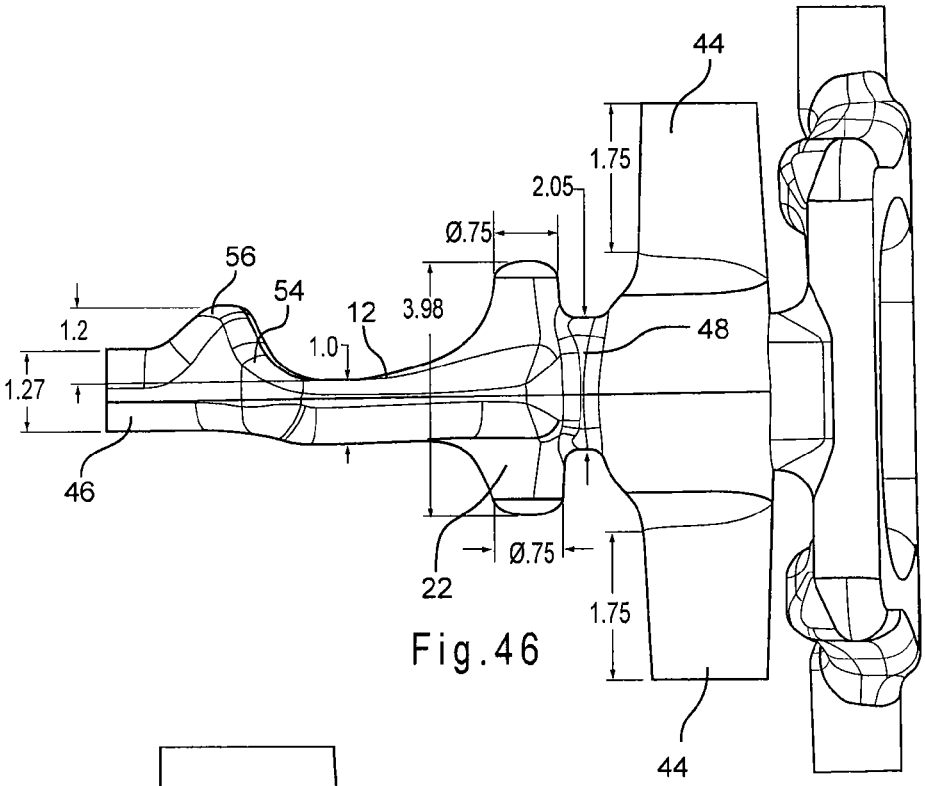
FIG. 46 is a side plan view of the finger and kidney cores of FIG. 6*a*.
Figure 47:
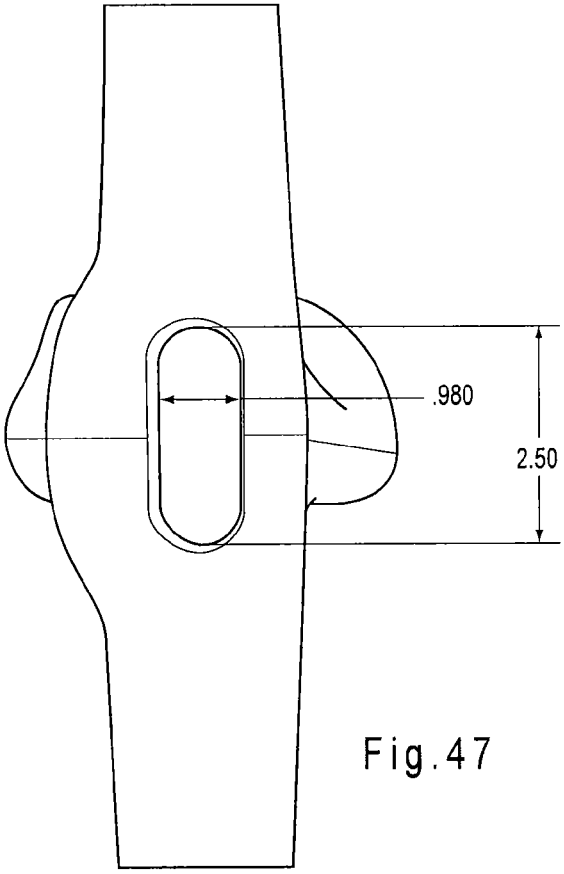
FIG. 47 is a side plan view of the kidney core and the C10 relief of FIG. 6*a*.
Figure 48:
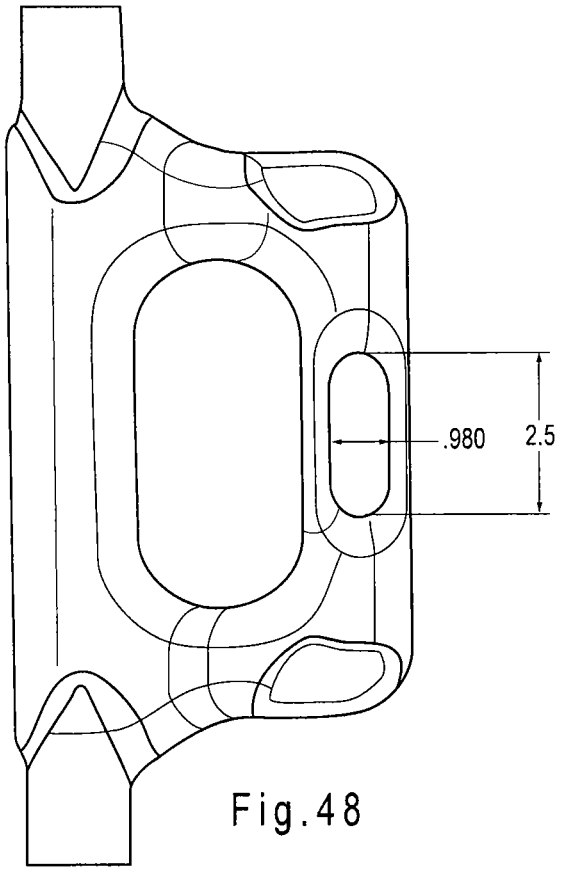
FIG. 48 is a side view of the finger core of FIG. 6*a*.
Figure 49:
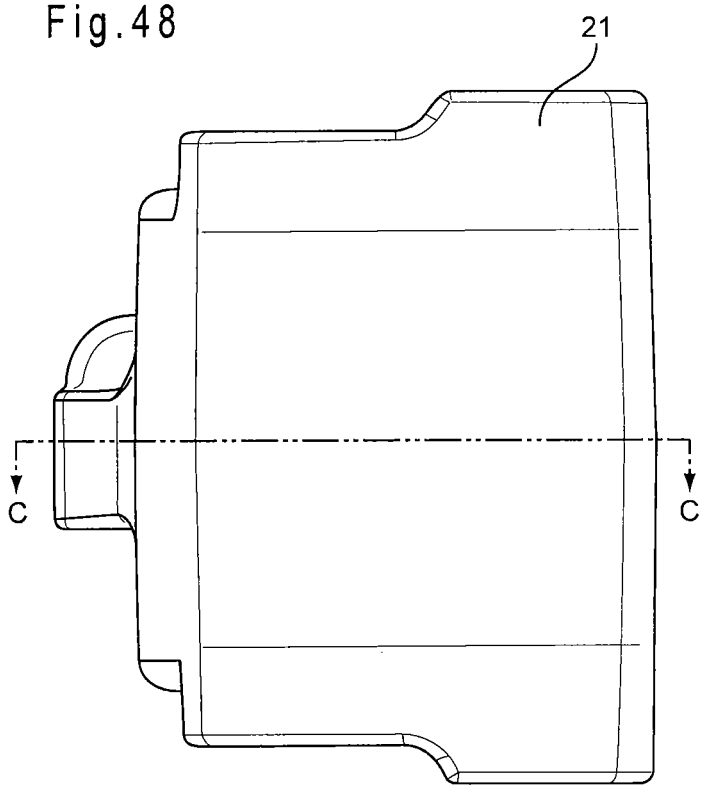
FIG. 49 is a side plan view of the knuckle of FIG. 1.

As shown in FIG. 44, a pivot pin core 13 includes about 1.7" in diameter sections 42 that form pivot pin holes 38 on each end of the hub 40. The holes 38 travel toward a larger center C-10 relief that is formed by section 44 which is drafted outward at about 2 degrees on the pivot pin core 13 as shown in FIGS. 8 and 9. A cross-section of the C-10 relief at the knuckle center plane consists of a series of arcs and parabolic sections. This irregular center cross section 17 is roughly 2.5"×2.6". As shown in FIG. 46, the C-10 relief 44 tapers back to the diameter of the pivot pin holes 38 at a distance of about 1.8" away from each side of the knuckle center. As shown in FIG. 9, the C-10 relief 44 includes an about 2.5" tall and about 1.0" wide oblong slot 16 to receive the finger core lug 14. As shown in FIGS. 6 and 47, the finger core lug 14 is an about 2.5" tall and about 1.0" wide oblong post 14 and serves as the method for attaching the separate finger core 10 to the pivot pin section 13 before casting. The internal radiuses of the center C-10 section are preferably smoothed to reduce stresses and increase fatigue life.

The Figures also illustrate other areas where the kidney core 12, pivot pin 13 core, and the finger core 10 have been modified to further reduce stresses in the resulting knuckle. Unless otherwise specified, the measurements given for the adjusted radii in the present invention are given in inches (for example R.1" or R1.2")

The kidney core 12 creates the internal surfaces of the rear of the knuckle 21 from behind the pivot pin hole 38 to the tail 46. This areas is best illustrated in FIGS. 2 and 3. The kidney core 12 is part of the pivot pin core 13 and attached by an about 2.1" tall by 0.7" wide section 48. (FIGS. 44 and 46). The buffing shoulder cores 22 extend from this attachment point and measure approximately 0.78" in diameter and have an overall height of about 4.0". (FIG. 46). The buffing shoulder cores 22 each taper outward on into the main body of the kidney core 12. The main section of the kidney core 12 measures about 3.6" across and about 1.0" thick. (FIGS. 44 and 46). The modified dimensions of the kidney core 12 result in thicker wall sections in the rear section of the knuckle 21 and improves stresses and fatigue life.

Figure 50:
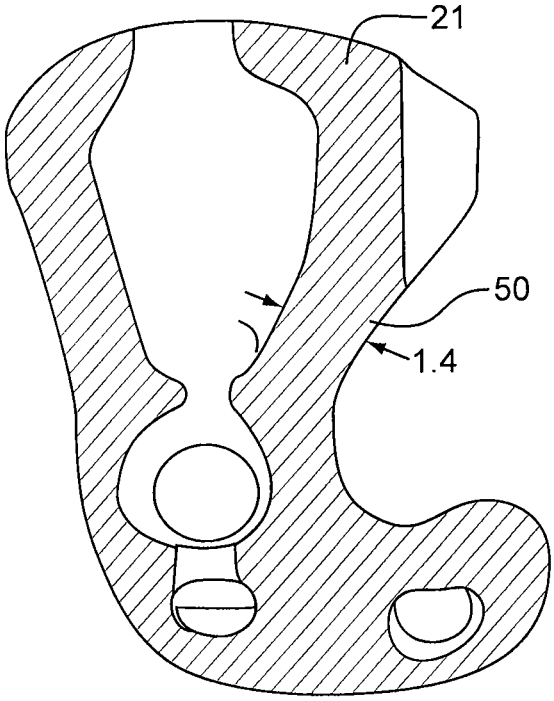
FIG. 50 is a cross sectional view along line C-C of FIG. 49.
Figure 51:
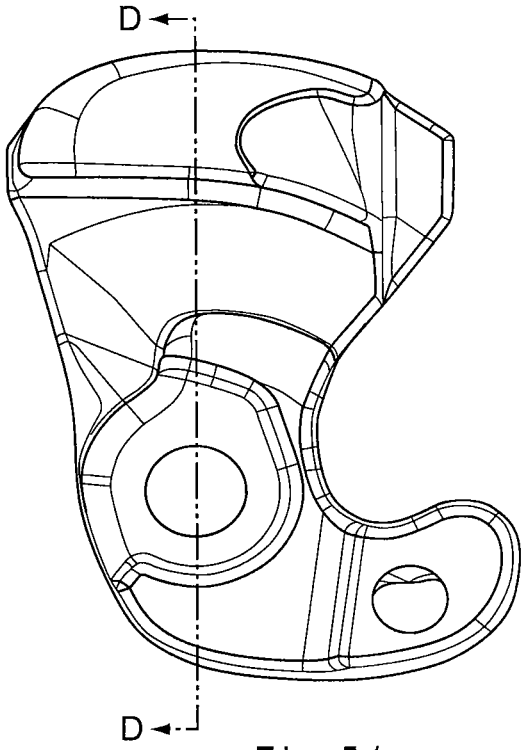
FIG. 51 is a top plan view of the knuckle of FIG. 1.
Figure 52:
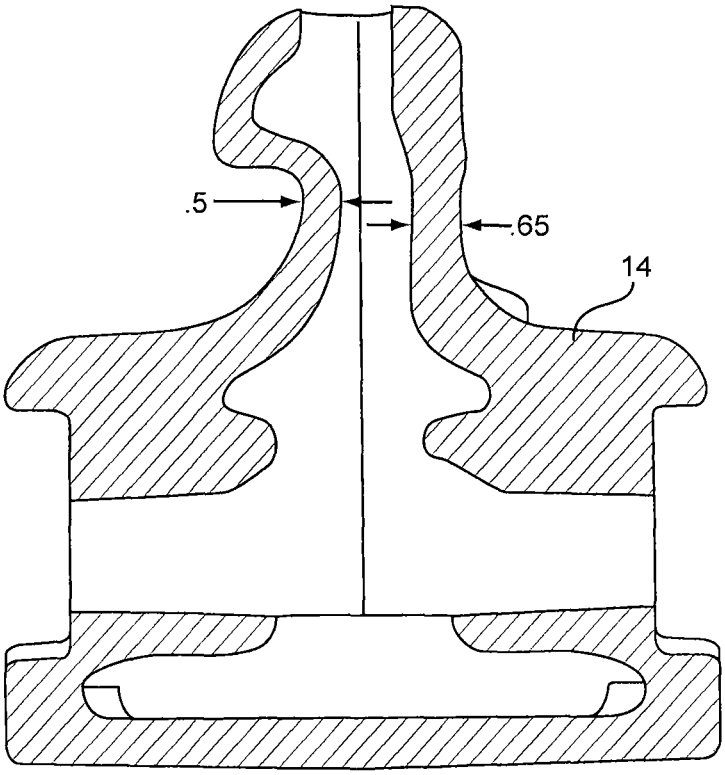
FIG. 52 is a cross sectional view of the interior of the knuckle of FIG. 1 along line D-D of FIG. 51.

The resulting wall thickness on the lock face 50 and just before the lock face 50 is about 1.4". (FIG. 50). The resulting wall thickness on the tail stop side 52 of the kidney core 12 is about 1.2". (FIG. 46). The resulting wall thickness below the kidney core 12 is about 0.67". (FIG. 52). The resulting wall thickness above the kidney core 12 is about 0.5". (FIG. 52).

Behind the main section of the kidney core 12 is the top pulling lug core 56 which extends about 1.2" above the top of the main section 54. (FIG. 46). Just behind the main section 54 and before the top pulling lug core 56 the width of the kidney core 12 begins to taper down. The taper narrows down to a final width of about 1.6" and 1.3" tall before extending out of the tail 46. (FIGS. 44 and 46). The internal radii of the kidney core 12 section are preferably smoothed to reduce stresses and increase fatigue life.

Many changes have been made to specific radii of the finger and kidney cores as described in the following paragraphs. The sections that are references are shaded in each figure for clarity. As previously stated, the radius measurements below are in inches.

Figure 6A:
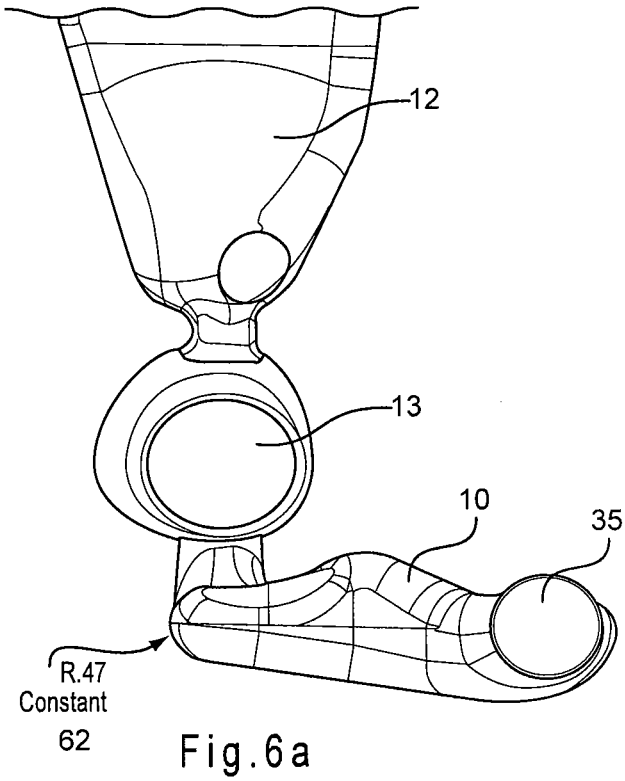
FIG. 6*a* is a top view of the finger and kidney cores of FIG. 6 in an assembled configuration.
Figure 6B:
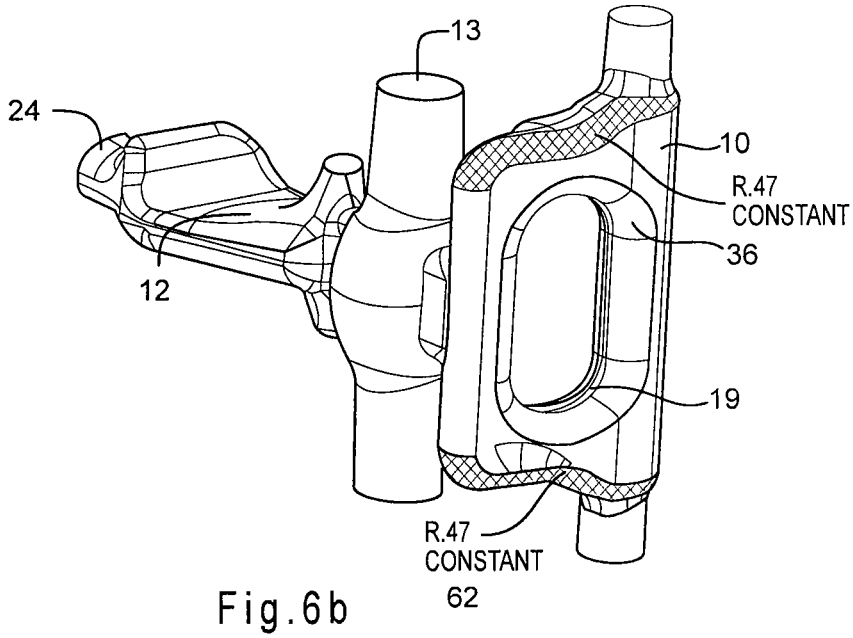
FIG. 6*b* is a perspective view of the finger and kidney cores of FIG. 6*a*.
Figure 6C:
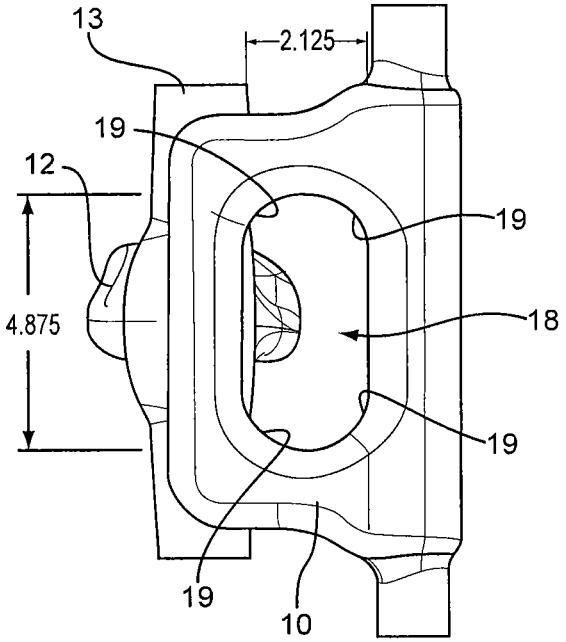
FIG. 6*c* is a side view of the finger and kidney cores of FIG. 6*a*.
Figure 11:
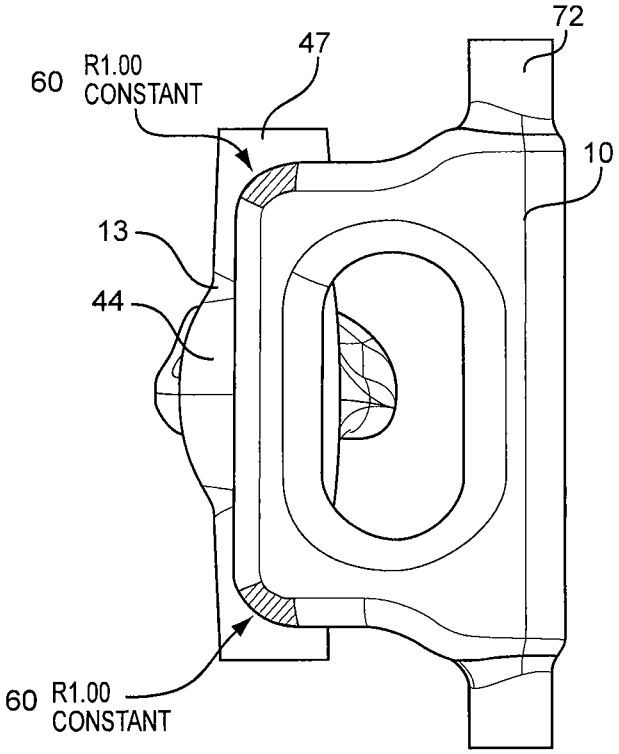
FIG. 11 is a side view of the finger and kidney cores of FIG. 6*a*.
Figure 12:
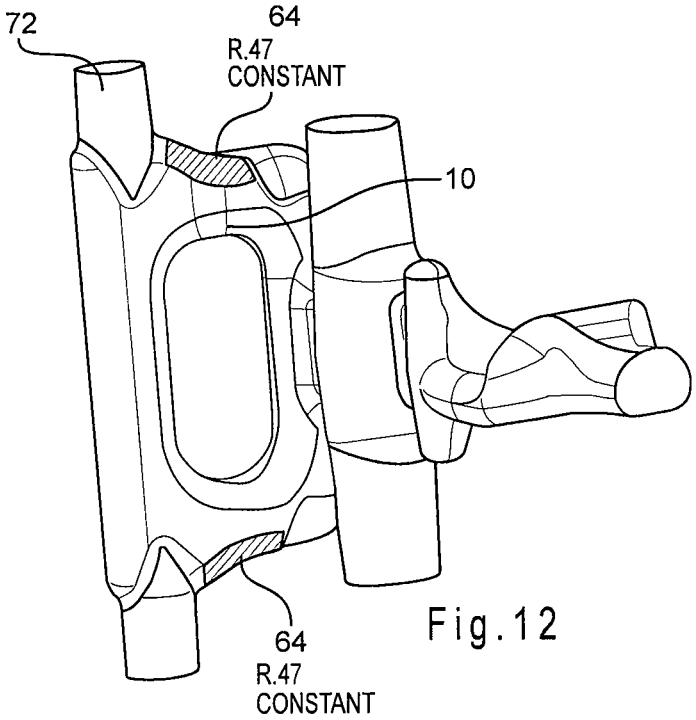
FIG. 12 is a perspective view of the finger and kidney cores of FIG. 6*a*.

The radius 58 where the section 42 forming the pivot pin hole 38 meets the section 44 forming the C-10 relief is a constant R1.0" for both the top and bottom radii (FIG. 8). The radii 60 on the outer top and bottom portions of the finger core 10 opposite of the flag hole core 72 are a constant R1.0" (FIG. 11). The radius 62 on the outer portion of the finger core 10 opposite of the flag hole core 72 is a constant R.47" (FIG. 6*a*). The radii 64 on the outer top and bottom of the finger core 10 are a constant R.47" (FIG. 6 and FIG. 12).

Figure 13:
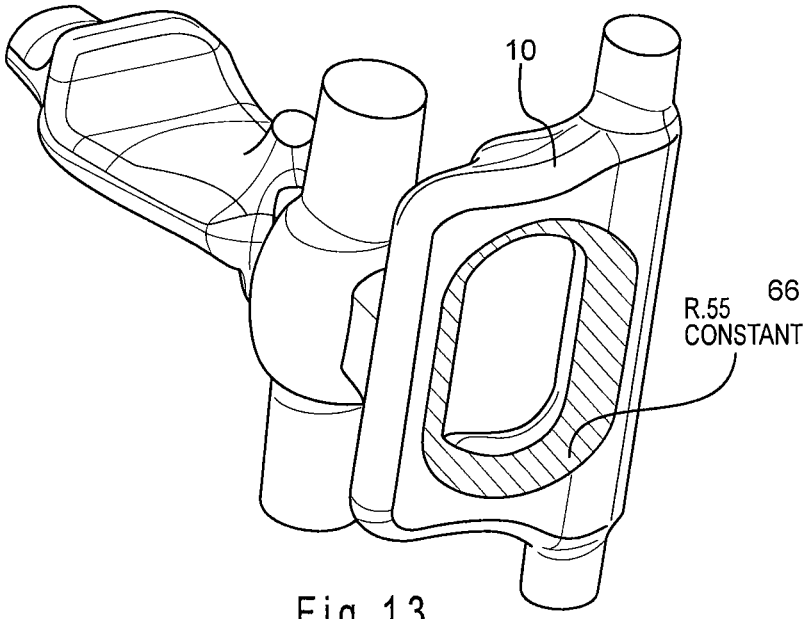
FIG. 13 is a perspective view of the finger and kidney cores of FIG. 6*a*.
Figure 14:
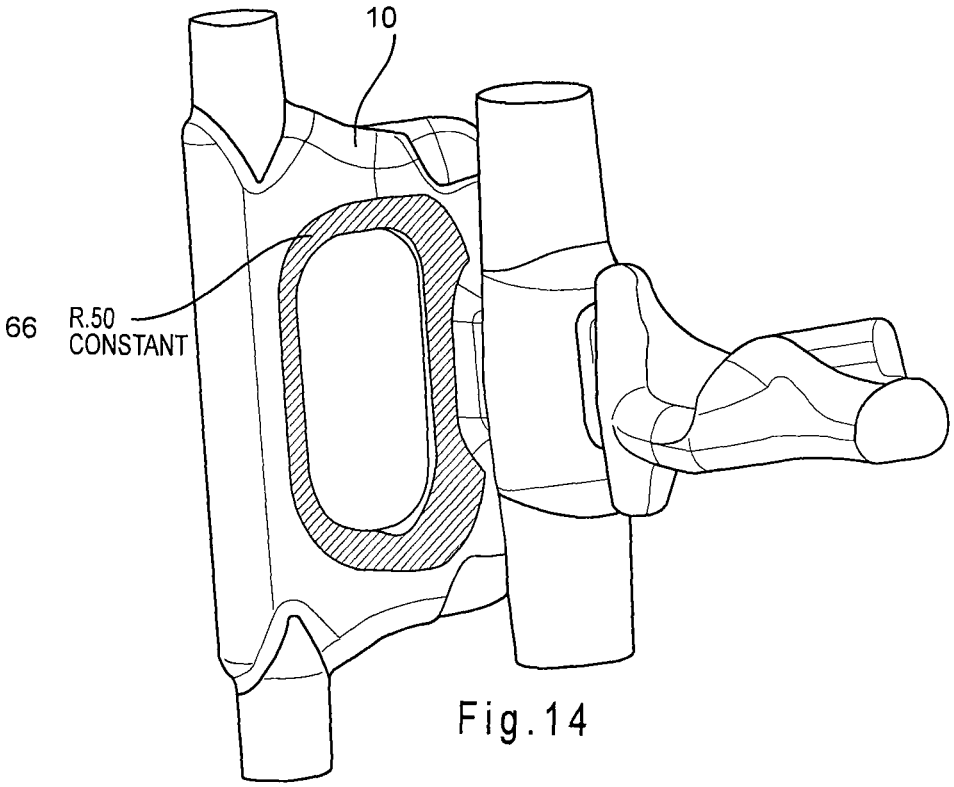
FIG. 14 is a perspective view of the finger and kidney cores of FIG. 6*a*.
Figure 15:
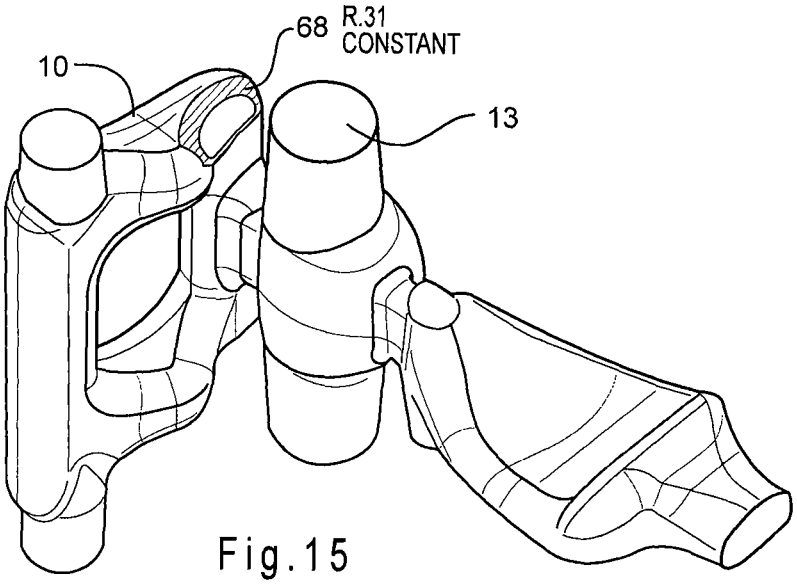
FIG. 15 is a perspective view of the finger and kidney cores of FIG. 6*a*.
Figure 16:
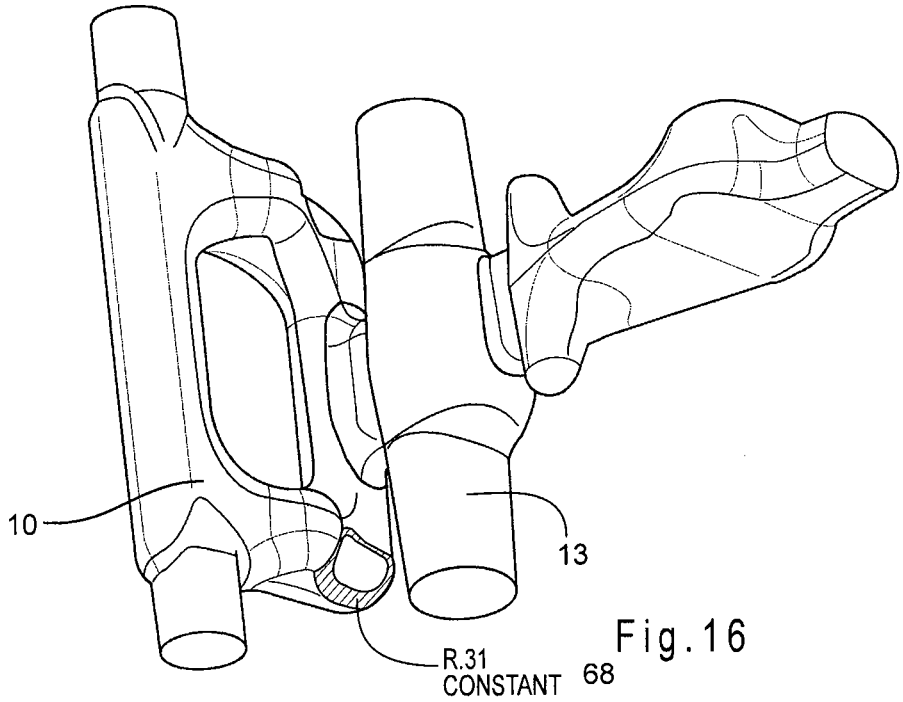
FIG. 16 is a perspective view of the finger and kidney cores of FIG. 6*a*.
Figure 17:
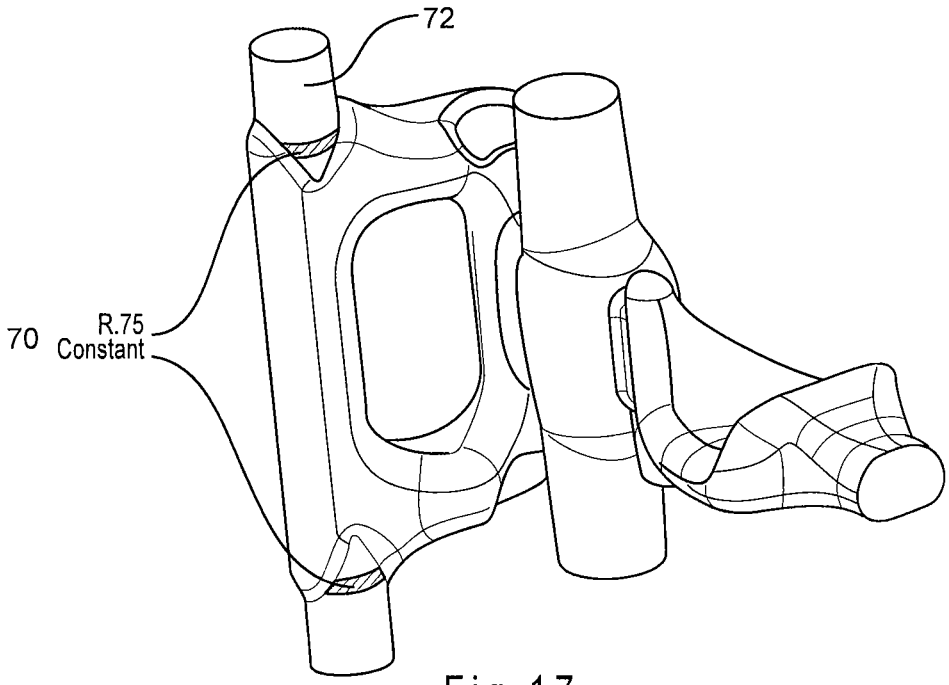
FIG. 17 is a perspective view of the finger and kidney cores of FIG. 6*a*.
Figure 18:
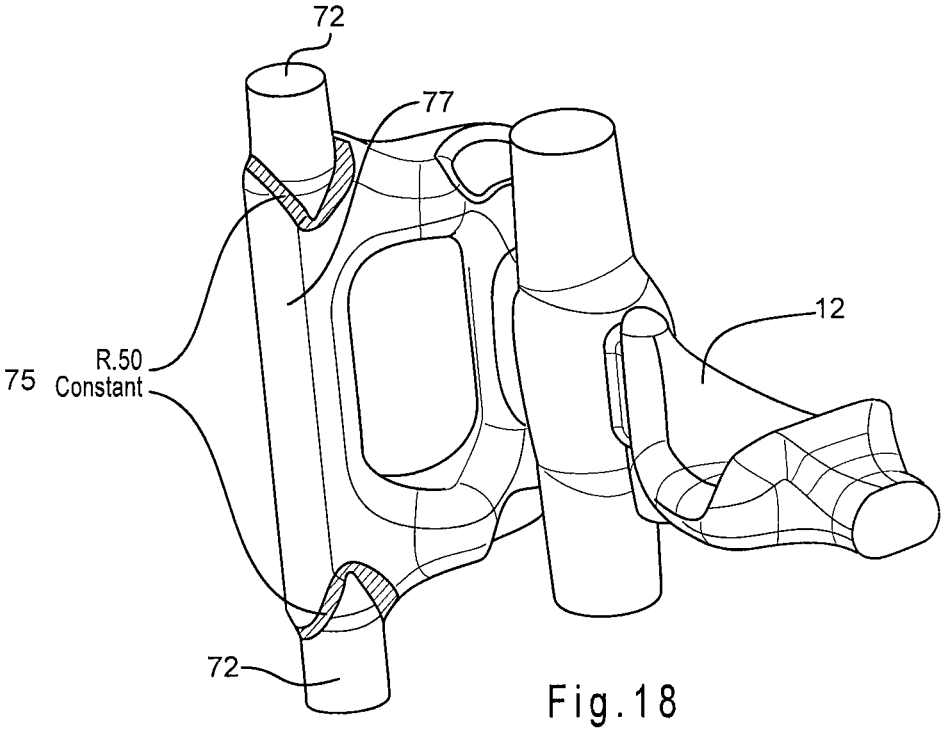
FIG. 18 is a perspective view of the finger and kidney cores of FIG. 6*a*.
Figure 19:
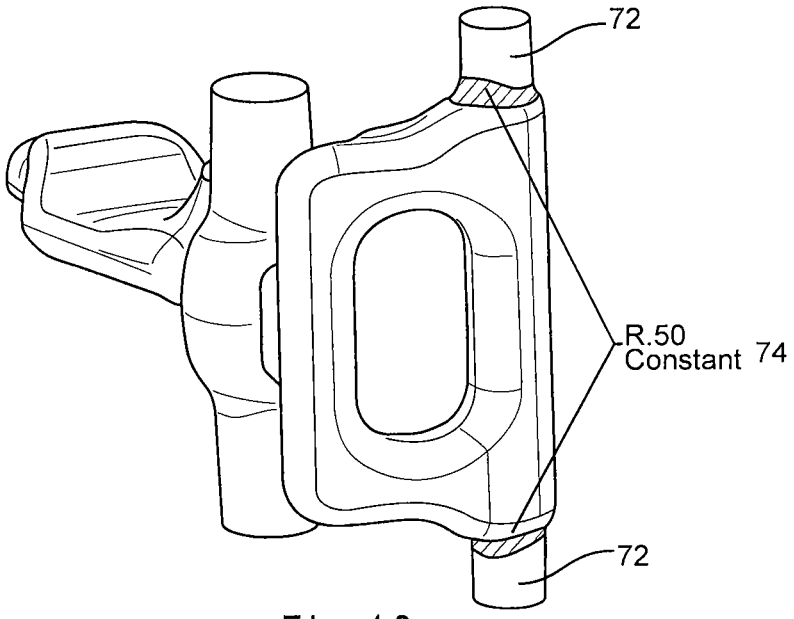
FIG. 19 is a perspective view of the finger and kidney cores of FIG. 6*a*.

The radii 66 on the front and back of the portion of the finger core 15 that forms the single thick rib are a constant R.55" (FIG. 13 and FIG. 14). The top and bottom radii 68 on the portions of the finger core 10 that are near the pivot pin core 13 are a constant R.31" (FIG. 15 and FIG. 16). The radii 70 the top and bottom flag hole core 72 are a constant R.75" (FIG. 17). The radii 75 that fall between the top and bottom flag hole cores 72 and the main cylinder 77 that connects them have a constant R.50" radii. The radii 74 that join the top and bottom flag hole cores 72 to the finger core 10 are a constant R.50" (FIG. 19).

Figure 7:
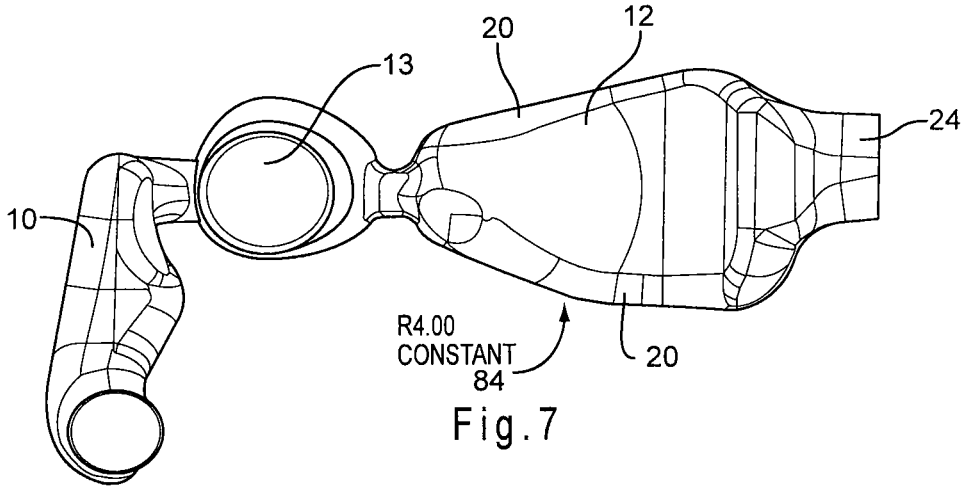
FIG. 7 is a top view of the finger and kidney cores of FIG. 6*a*.
Figure 20:
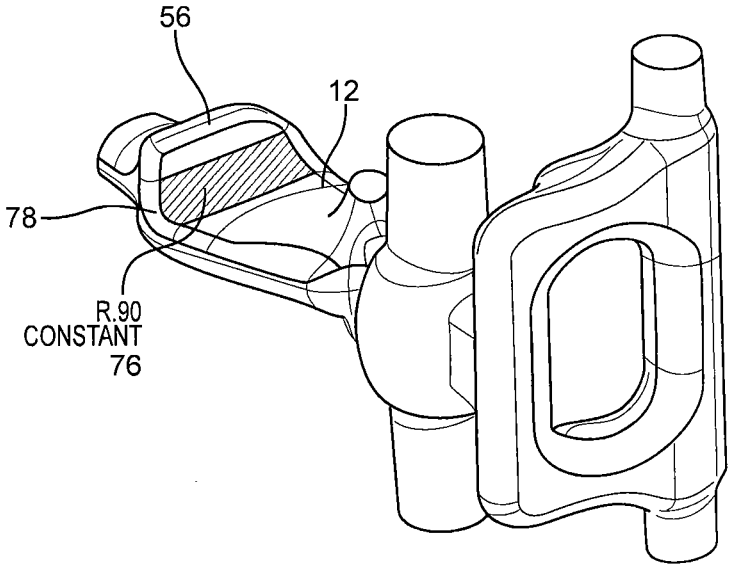
FIG. 20 is a perspective view of the finger and kidney cores of FIG. 6*a*.
Figure 21:
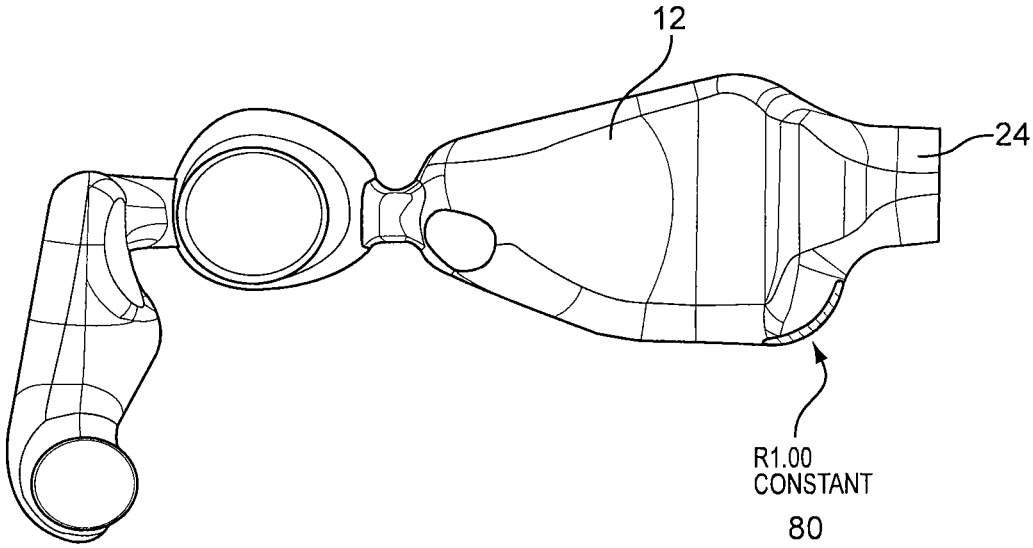
FIG. 21 is a top view of the finger and kidney cores of FIG. 6*a*.
Figure 22:
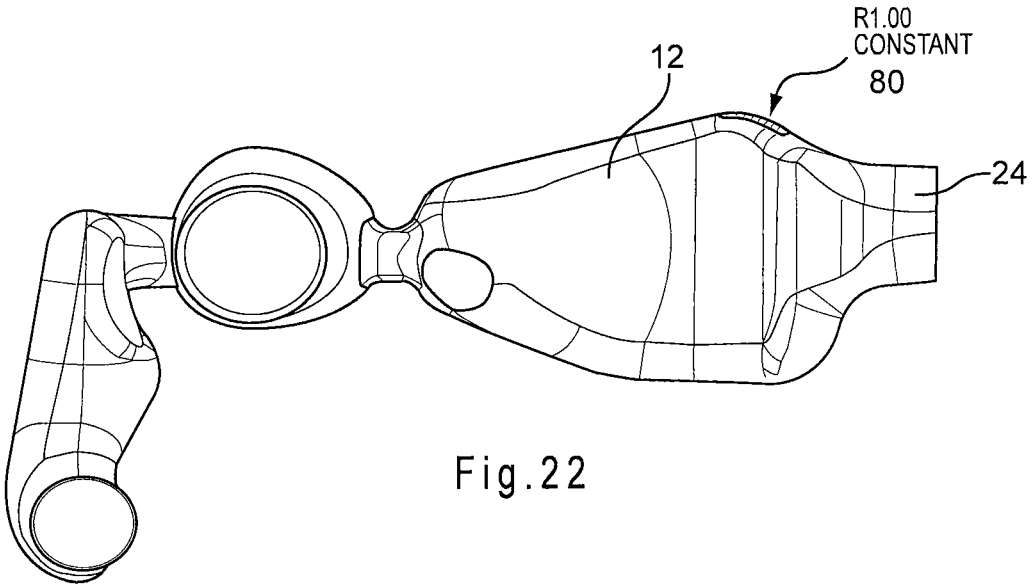
FIG. 22 is a top view of the finger and kidney cores of FIG. 6*a*.
Figure 23:
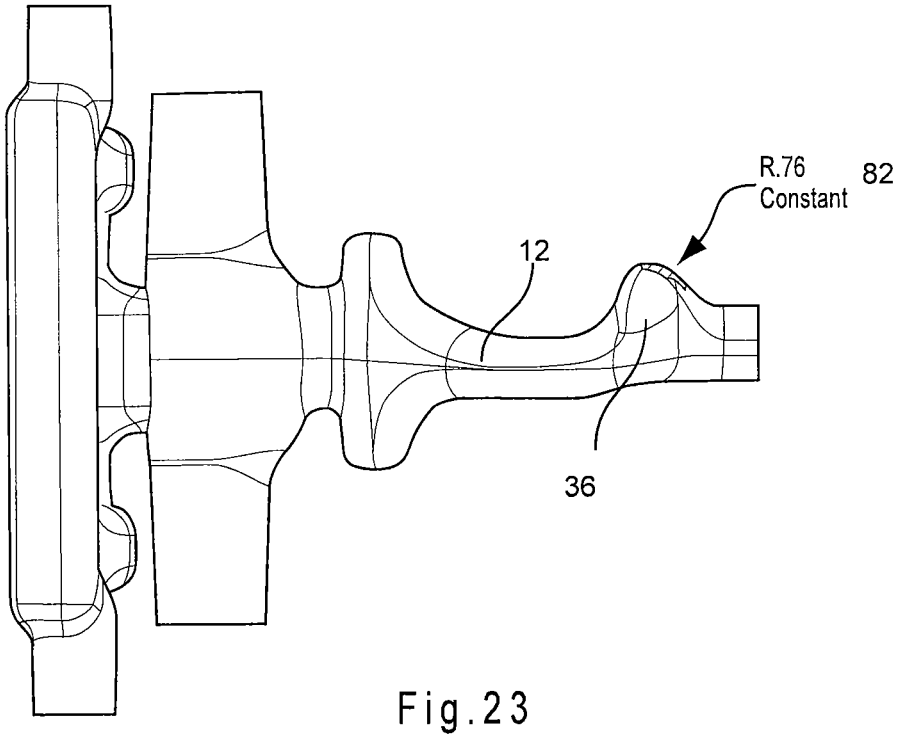
FIG. 23 is a side view of the finger and kidney cores of FIG. 6*a*.
Figure 24:
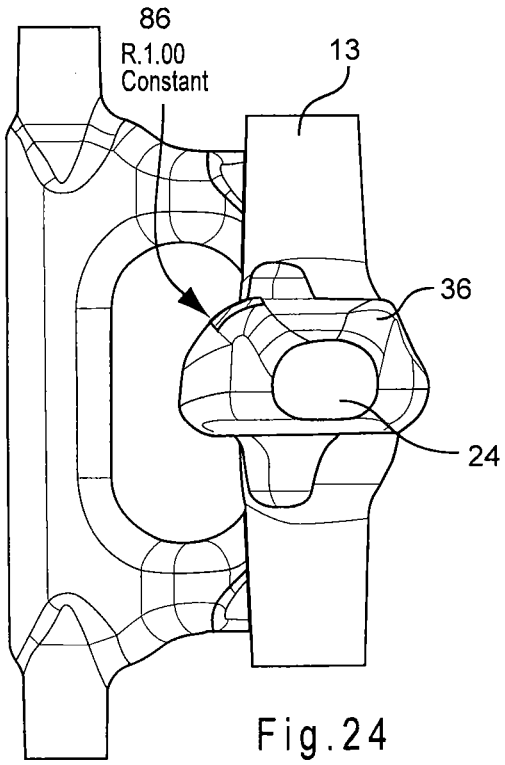
FIG. 24 is a side view of the finger and kidney cores of FIG. 6*a*.
Figure 25:
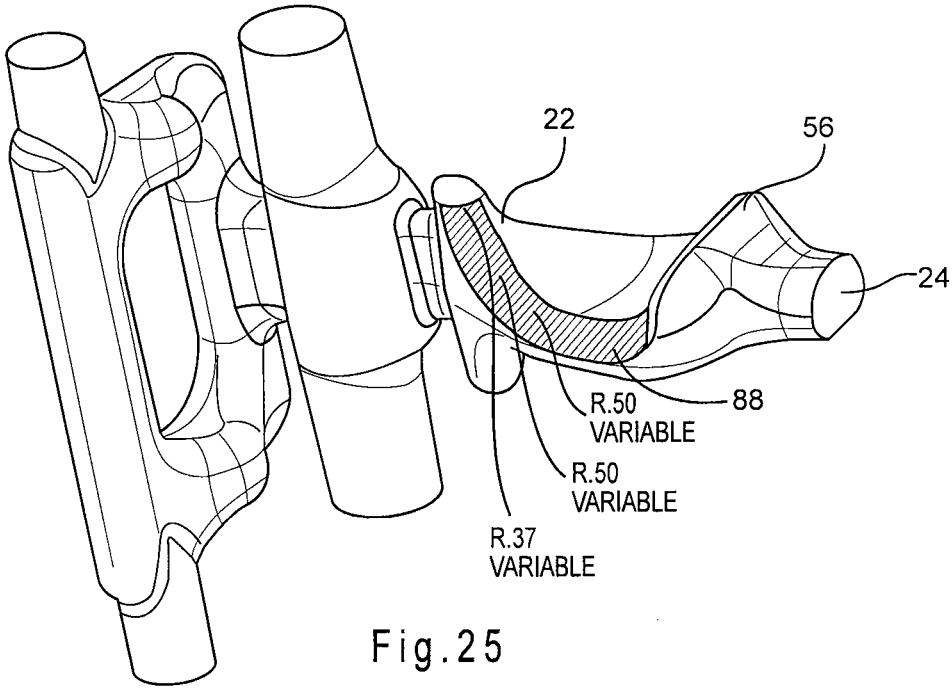
FIG. 25 is a perspective view of the finger and kidney cores of FIG. 6*a*.
Figure 26:
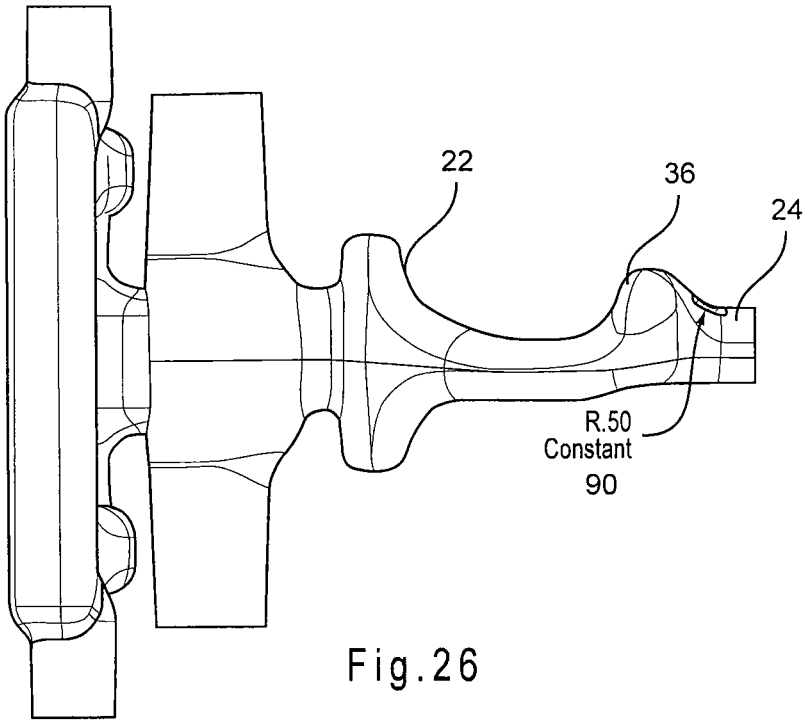
FIG. 26 is a side view of the finger and kidney cores of FIG. 6*a*.
Figure 27:
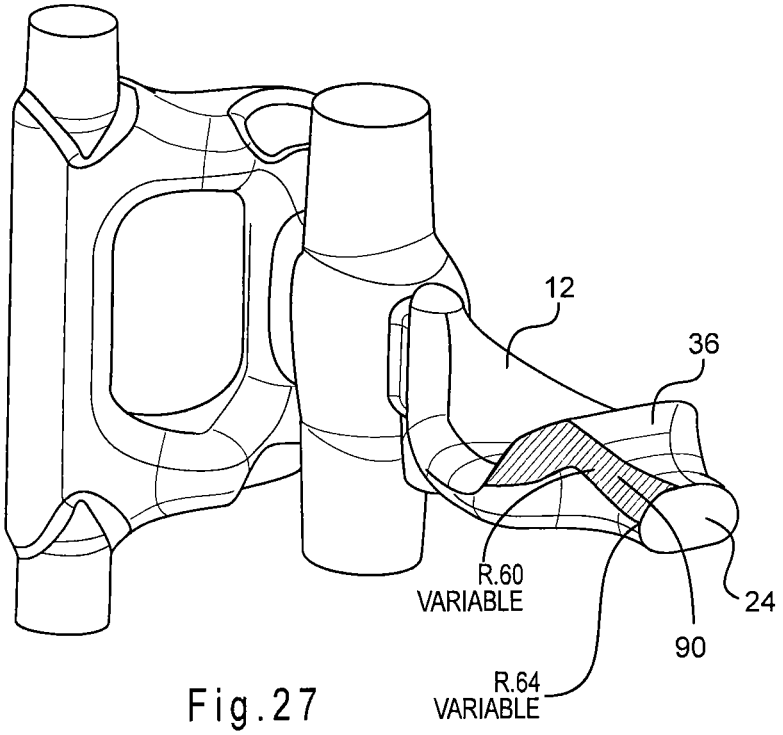
FIG. 27 is a perspective view of the finger and kidney cores of FIG. 6*a*.
Figure 28:
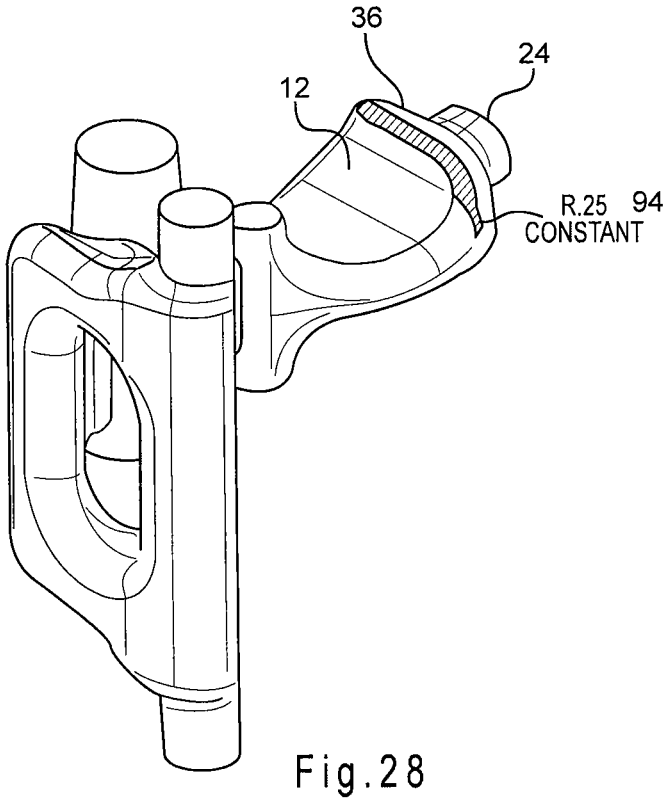
FIG. 28 is a perspective view of the finger and kidney cores of FIG. 6*a*.

The radius 76 that forms the base 78 of the pulling lug core 36 in the kidney core 12 is a constant R.90" (FIG. 20). The radii 80 on the each side of the kidney core 12 near the section 24 forming the rear core support hole are a constant R1.00" (FIGS. 21 and 22). The radius 82 on the back of the top of the pulling lug core 36 on the kidney core 12 is a constant R.76" (FIG. 26) The radius 84 on the kidney core 12 near the throat 85 is a constant R4.00" (FIG. 7). The radius 86 on the throat side of the top of the top pulling lug core 36 of the kidney core 12 is a constant R1.00" (FIG. 24). The radius 88 on the throat side of the top buffing shoulder core 22 of the kidney core 12 is a continuous variable radius fillet that starts at R.50" and tapers to R.37 as it travels up the buffing shoulder core 22 (FIG. 25). The radius 90 that joins the back of the pulling lug core 56 to the section forming the rear support hole 24 is a constant R.50" (FIG. 26). The radius 90 on the throat side behind the pulling lug core 36 of the kidney core 12 is a continuous variable radius fillet that starts at R.60" and expands to R.64" as it travels out to the section 24 that forms the core support hole (FIG. 27). The radius 94 on the top of the front of the pulling lug core 36 is a constant R.25" (FIG. 28).

Figure 29:
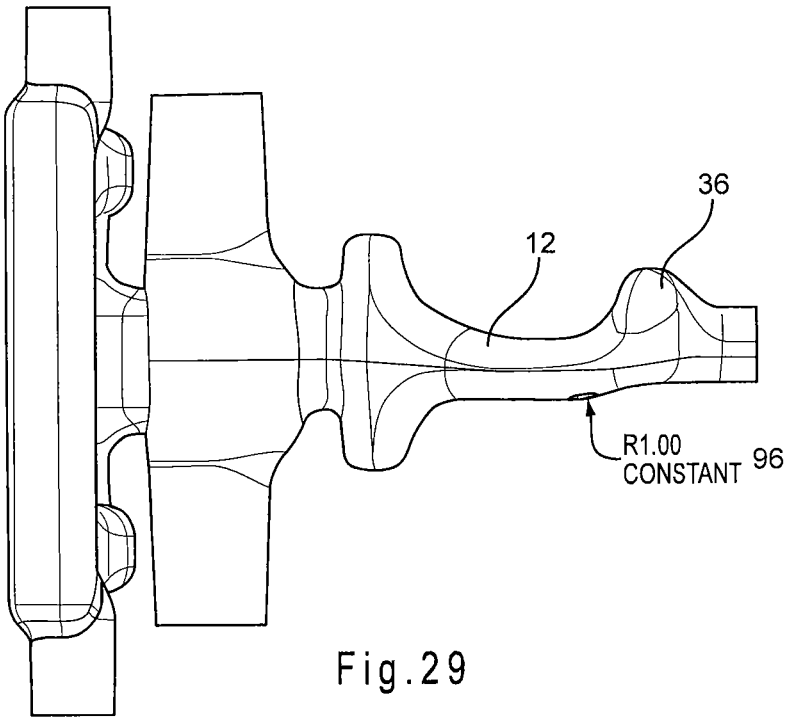
FIG. 29 is a side view of the finger and kidney cores of FIG. 6*a*.
Figure 30:
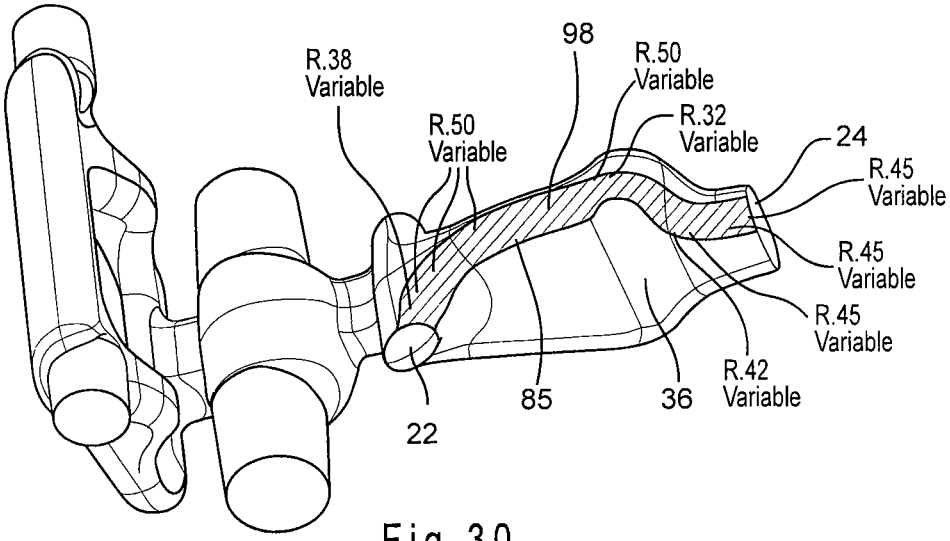
FIG. 30 is a perspective view of the finger and kidney cores of FIG. 6*a*.
Figure 31:
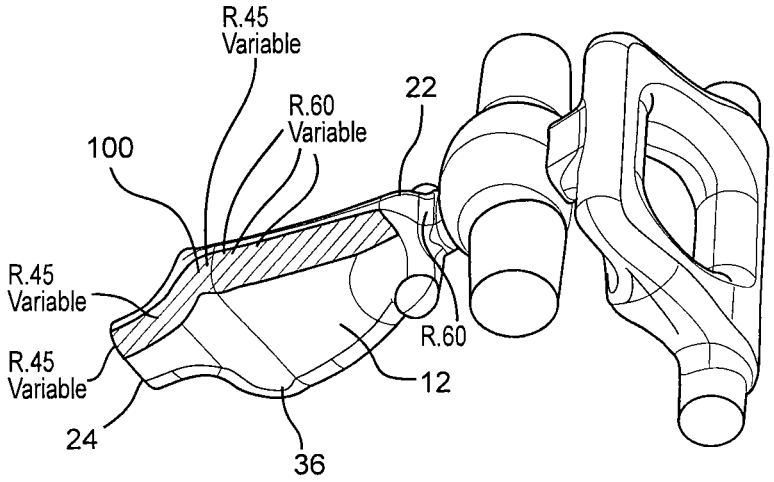
FIG. 31 is a perspective view of the finger and kidney cores of FIG. 6*a*.
Figure 32:
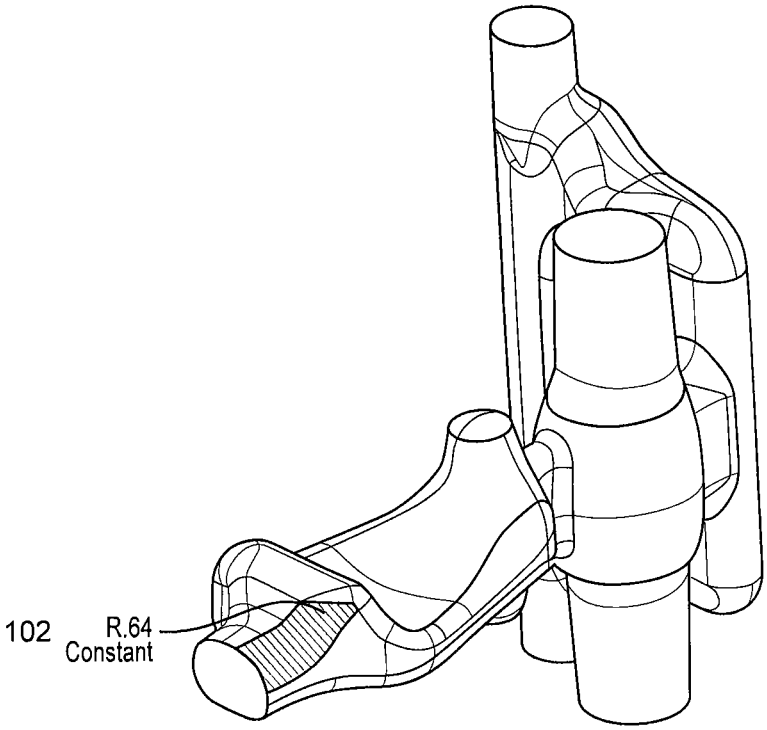
FIG. 32 is a perspective view of the finger and kidney cores of FIG. 6*a*.
Figure 33:
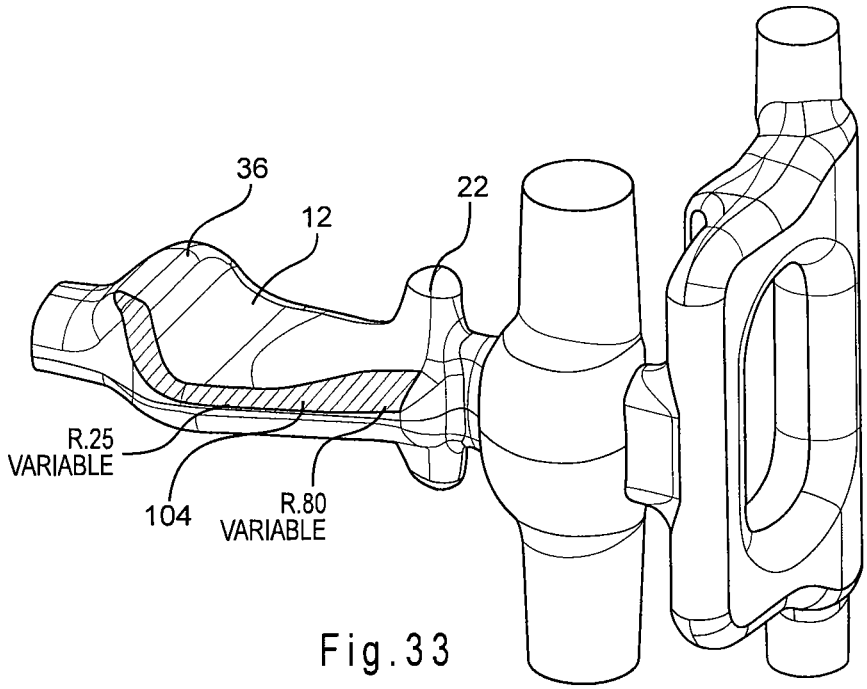
FIG. 33 is a perspective view of the finger and kidney cores of FIG. 6*a*.
Figure 34:
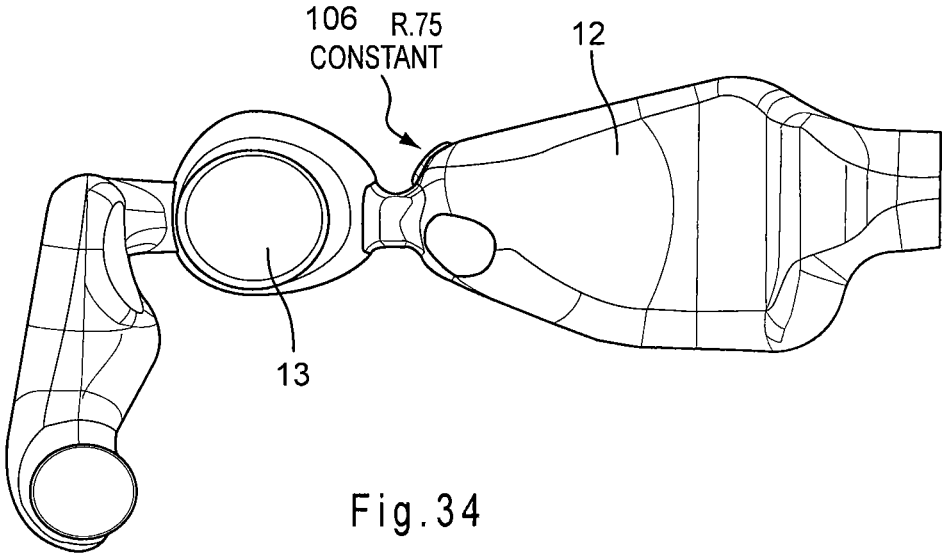
FIG. 34 is a bottom view of the finger and kidney cores of FIG. 6*a*.
Figure 35:
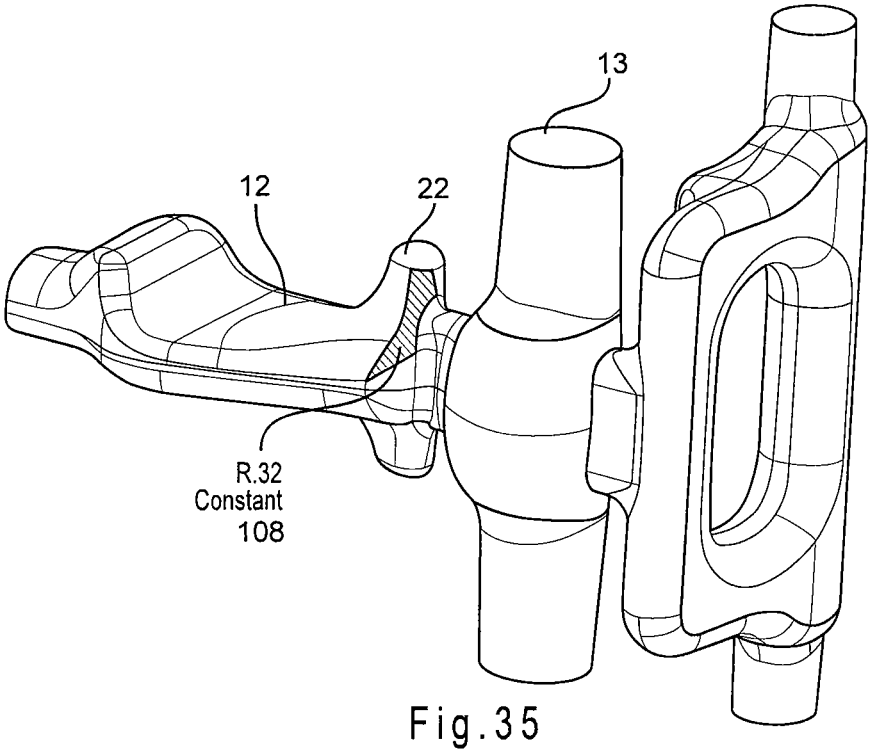
FIG. 35 is a perspective view of the finger and kidney cores of FIG. 6*a*.
Figure 36:
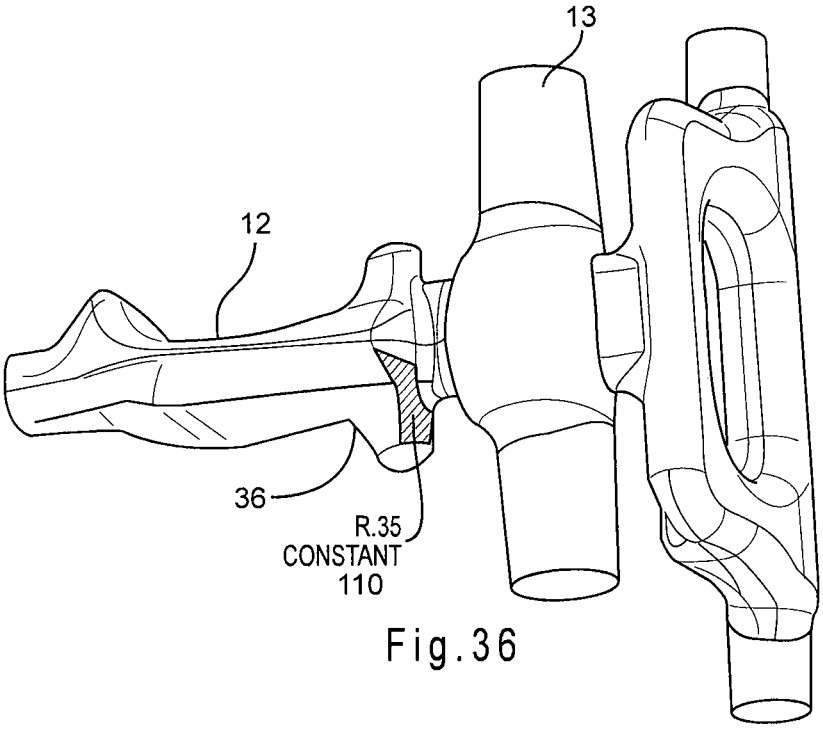
FIG. 36 is a perspective view of the finger and kidney cores of FIG. 6*a*.
Figure 37:
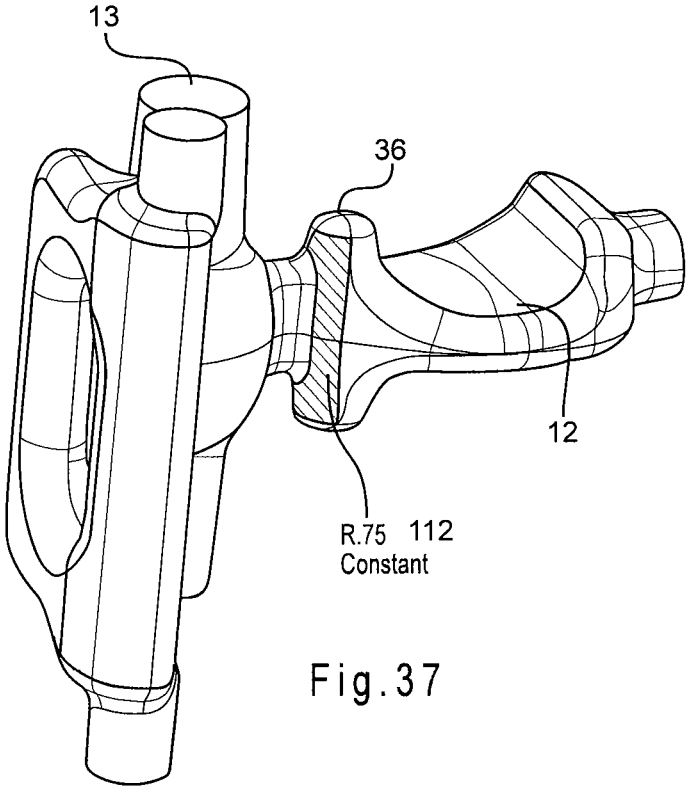
FIG. 37 is a perspective view of the finger and kidney cores of FIG. 6*a*.

The radius 96 on the bottom of the kidney core 12 just before the pulling lug core 36 is a constant R1.00"(FIG. 29). The radius 98 on the throat side of the bottom buffing shoulder core 22 of the kidney core 12 is a variable radius fillet that starts at R.45" near the rear core support hole formed by the lug 24 and tapers to R.32" near the pulling lug core 36 and then widens to R.50" in the portion near the throat 85 and then tapers to R.38" as it travels down the buffing shoulder core 22 (FIG. 30). The bottom radius 100 on the tail stop side of the kidney core 12 is a continuous variable radius fillet that starts at R.45" near section 24 that forms the rear core support hole and widens to R.60" as it travels toward the buffing shoulder core 22 (FIG. 31). The top radius 102 on the C-10 side of the kidney core 12 near the section 24 forming the rear core support hole is a constant R.64" (FIG. 32). The top radius 104 on the C-10 side of the kidney core 12 is a variable radius fillet that starts at R.25" at the pulling lug core 36 and widens to R.80" as it travels toward the buffing shoulder core 22 (FIG. 33). The radius 106 on the front on the C-10 side of the kidney core 12 near the pivot pin core 13 is a constant R.75" (FIG. 34). The radius 108 on the front of the top buffing shoulder core 22 on the C-10 side of the kidney core 12 near the pivot pin core 13 is a constant R.32" (FIG. 35). The radius 110 on the front of the bottom buffing shoulder core 36 on the C-10 side of the kidney core 12 near the pivot pin core 13 is a constant R.35" (FIG. 36). The radius 112 on the front of the top and bottom buffing shoulder core 36 on the throat side of the kidney core 12 near the pivot pin core 13 is a constant R.75" (FIG. 37).

Figure 38:
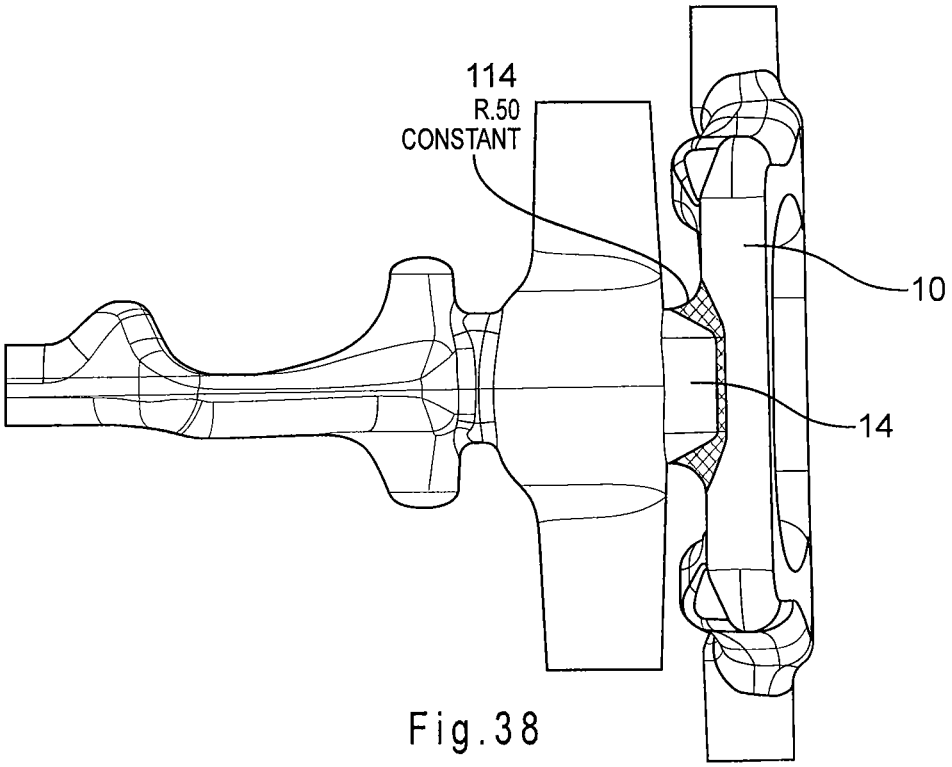
FIG. 38 is a side view of the finger and kidney cores of FIG. 6*a*.
Figure 39:
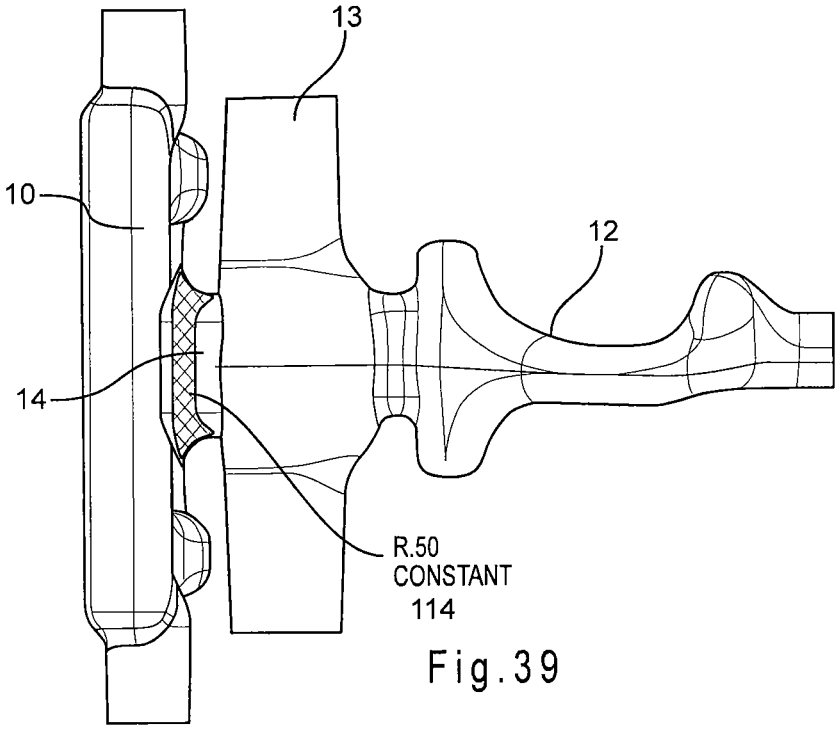
FIG. 39 is a side view of the finger and kidney cores of FIG. 6*a*.
Figure 40:
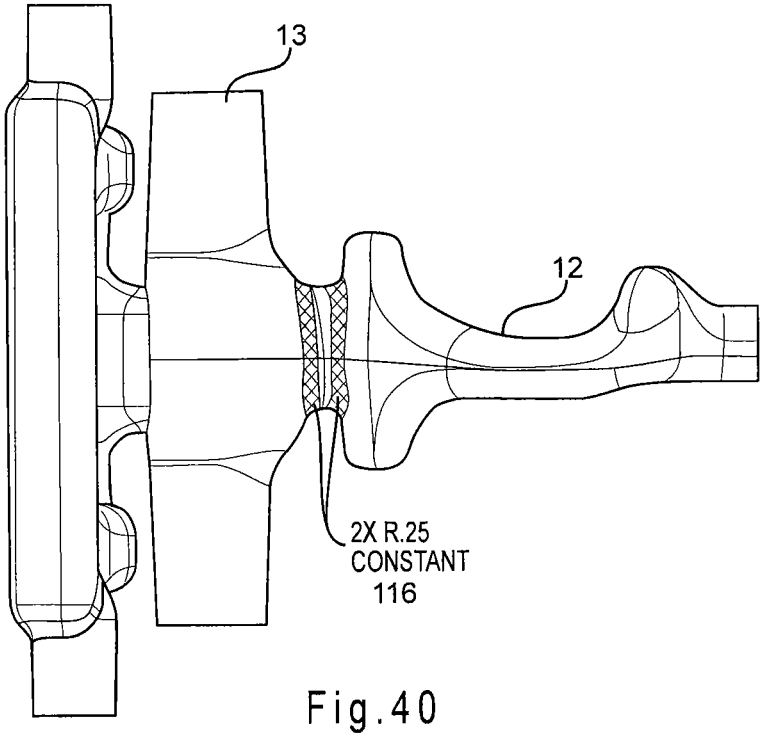
FIG. 40 is a side view of the finger and kidney cores of FIG. 6*a*.
Figure 41:
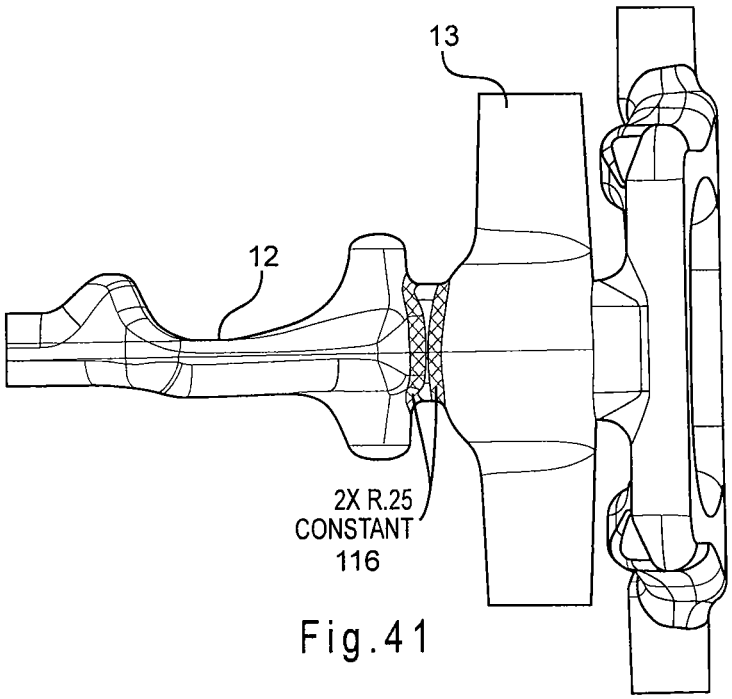
FIG. 41 is a side view of the finger and kidney cores of FIG. 6*a*.

The fillet 114 where the post 14, used to attach the finger core 10 to the pivot pin core 13, where it joins with the finger core 10 is a constant R.50" (FIGS. 38 and 39). The fillets 116 that join the pivot pin core 13 to the kidney core 12 are a constant R.25" (FIG. 40 and FIG. 41).

Figure 42:
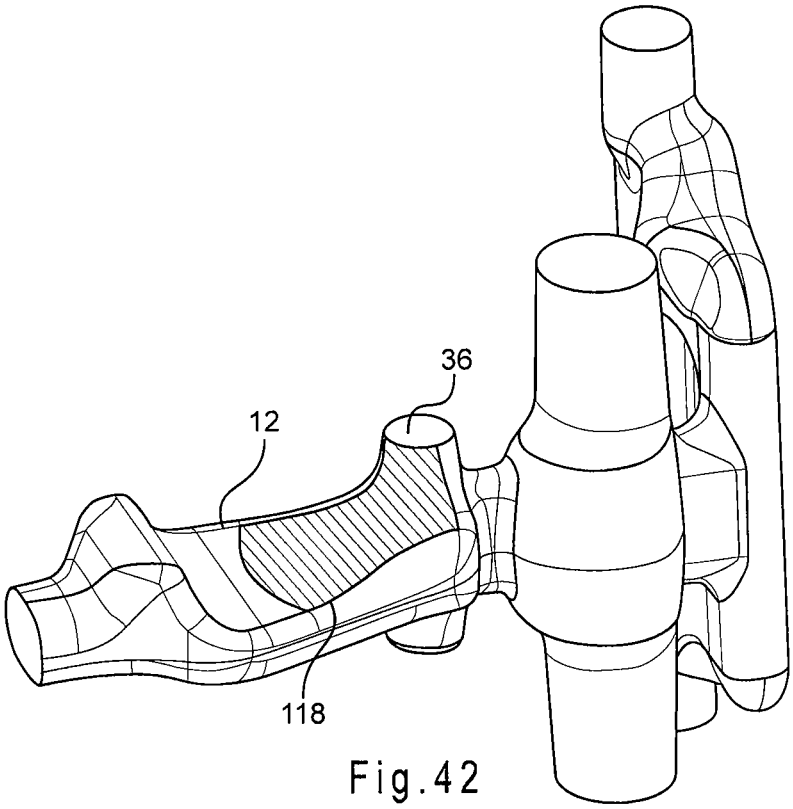
FIG. 42 is a perspective view of the finger and kidney cores of FIG. 6*a*.
Figure 43:
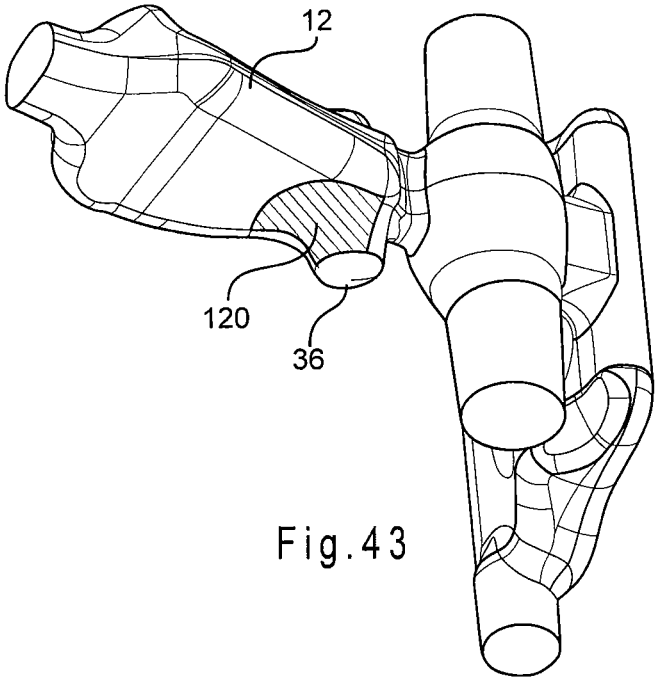
FIG. 43 is a perspective view of the finger and kidney cores of FIG. 6*a*.

The top buffing shoulder core 36 consists of a single lofted surface 118 that starts on the flat surface of the kidney core 12 and travels up through the buffing shoulder core 36 (FIG. 42). The bottom buffing shoulder core 36 consists of a single lofted surface 120 that starts on the flat surface of the kidney core 12 and travels down through the buffing shoulder core 36 (FIG. 43).

It is intended that the foregoing detailed description be regarded as illustrative rather than limiting, and that it be understood that it is the following claims, including all equivalents, that are intended to define the spirit and scope of this invention.

The invention claimed is:

1. A finger core for forming the front part of a knuckle for a railcar, said finger core comprising:

a single opening to form a single rib at the horizontal center line of a resulting knuckle, wherein said single opening is about 2.1" high and about 4.9" wide, and wherein said single opening has four corners that are rounded and symmetrically located in both front and back sides of the single opening, said single opening positioned in a flat plane that runs parallel to a flag hole core and along a length of the finger core, the length of the finger core running from the flag hole core on a first end of the finger core to a projection on a second end of the finger core that attaches the finger core to a C-10 pivot pin core.

2. The finger core of claim 1, wherein said corners of said single opening comprise radii of about a constant 0.47".

3. A set of cores for forming a knuckle for a railcar coupler that has increased strength and fatigue life, said set of cores comprising:

a finger core for forming the front part of a knuckle for a railcar, said finger core comprising a single opening to form a single rib in a resulting knuckle, wherein said single opening is about 2.1" high and about 4.9" wide, and wherein said single opening of said finger core has four rounded corners and is symmetrically located in both front and back sides of the single opening, said single opening positioned in a flat plane that runs parallel to a flag hole core and along a length of the finger core; and a core for forming the rear part of the knuckle for a railcar, said core comprising a kidney core section and a pivot pin core section;

wherein the length of the finger core runs from the flag hole core on a first end of the finger core to approximately a second plane that intersects the pivot pin and kidney core sections on a second end of the finger core.

4. The set of cores of claim 3, wherein said single rib is formed at the horizontal center line of the resulting knuckle.

5. The set of cores of claim 3, wherein said corners of said single opening comprise radii of about a constant 0.47".

6. The set of cores of claim 3, wherein the rounded four corners create a radius of about 0.55" in the front side of the single opening and where the rounded four corners create a radius of about 0.50" in the back side of the single opening.

7. A railcar coupler knuckle with increased strength and fatigue life, said knuckle comprising a single rib at a horizontal centerline of said knuckle, the single rib being about 2.1" high and about 4.9" wide, wherein an outer surface of the single rib is rounded symmetrically between front and back sides thereof, wherein said single rib is oriented in a flat plane that runs parallel to and along a length of the horizontal centerline, where a length of the single rib runs from between the flag hole on a first end of the single rib to a C-10 pivot pin hole on a second end of the single rib.

8. The finger core of claim 7, wherein the rounded four corners create a radius of about 0.55" in the front side of the single opening and where the rounded four corners create a radius of about 0.50" in the back side of the single opening.

9. A finger core for forming the front part of a knuckle for a railcar, said finger core comprising a single opening to form a single rib at about the horizontal center line of a resulting knuckle, the single opening including four corners rounded symmetrically in both front and back sides of the single opening, the single opening positioned in a flat plane that runs parallel to a flag hole core and along a length of the finger core.

10. The finger core of claim 9, wherein said corners of said single opening comprise radii of about a constant 0.47".

11. The finger core of claim 9, wherein the rounded four corners create a radius of about 0.55" in the front side of the single opening and where the rounded four corners create a radius of about 0.50" in the back side of the single opening.

12. A set of cores for forming an knuckle for a railcar coupler that has increased strength and fatigue life, said set of cores comprising:

a finger core for forming the front part of a knuckle for a railcar, said finger core comprising a single opening to form a single rib in a resulting knuckle, wherein said single opening of said finger core has four rounded corners and is symmetrically located in both front and back sides of the single opening, said single opening positioned in a flat plane that runs parallel to a flag hole core and along a length of the finger core; and a separate core for forming the rear part of the knuckle for a railcar, said separate core comprising a kidney core section and a pivot pin core section;

wherein the length of the finger core runs from the flag hole core on a first end of the finger core to approximately a second plane that intersects the pivot pin and kidney core sections on a second end of the figure core.

13. The set of cores of claim 12, wherein said single opening is about 2.1" high and about 4.9" wide.

14. The set of cores of claim 12, wherein said single rib is formed at the horizontal center line of the resulting knuckle.

15. The set of cores of claim 12, wherein said corners of said single opening comprise radii of about a constant 0.47".

16. A finger core for forming the front part of a knuckle for a railcar, said finger core comprising a single opening in a flat plane that runs parallel along a length of the finger core, the single opening to form a single rib at the horizontal center line of a resulting knuckle, wherein the length of the finger core runs from a flag hole core on a first end of the finger core to a projection on a second end of the finger core that attaches the finger core to a C-10 pivot pin core.

17. The finger core of claim 16, wherein said single opening comprises a rectangle that is about 2.1" high and about 4.9" wide.

* * * * *